US005453349A

United States Patent [19]

Takada et al.

[11] Patent Number: 5,453,349

[45] Date of Patent: Sep. 26, 1995

[54] PACKAGE OF PHOTOGRAPHIC LIGHT-SENSITIVE FILM

[75] Inventors: Masahito Takada; Takatoshi Yajima; Hideyuki Kobayashi, all of Hino, Japan

[73] Assignee: Konica Corporation, Tokyo, Japan

[21] Appl. No.: 269,196

[22] Filed: Jun. 30, 1994

[30] Foreign Application Priority Data

Jul. 15, 1993 [JP] Japan ..... 5-175560

[51] Int. Cl.[6] ..... G03C 1/81; G03C 1/795

[52] U.S. Cl. ..... 430/496; 430/501; 430/533; 430/534; 430/535; 430/930; 242/348.4; 206/316.1; 206/455

[58] Field of Search ..... 242/348.4; 206/316.1, 206/455, 578; 430/496, 501, 930, 533, 534, 535

[56] References Cited

U.S. PATENT DOCUMENTS 4,255,516 3/1981 Katoh et al. ..... 430/533
5,057,403 10/1991 Kume et al. ..... 430/496

FOREIGN PATENT DOCUMENTS 4-124657 4/1992 European Pat. Off. ..... 430/501
0568268 11/1993 European Pat. Off. ..... 430/533
4-3050 1/1992 Japan ..... 430/501

*Primary Examiner*—Charles L. Bowers, Jr.
*Assistant Examiner*—Mark F. Huff
*Attorney, Agent, or Firm*—Frishauf, Holtz, Goodman, Langer & Chick

[57] ABSTRACT

A package of photographic light-sensitive film is disclosed. The package comprises a cartridge enclosing a spool and a stripe of a photographic light-sensitive film rolled up on said spool, in which the cross sectional area of the cartridge is not larger than 370 $mm^2$, and the cross sectional area of the spool is not larger than 95 $mm^2$. The free space ratio V in the cartridge calculated by the following equations is not more than 0.25; and said photographic light-sensitive film comprises silver halide emulsion layer and a support comprising two or more laminated layers each composed of a polyester or a copolymeric polyester, respectively;

$$V=(B-A)/B$$

wherein $A$ = a cross sectional area of the light-sensitive film rolled in the cartridge
= Thickness × length of the light-sensitive film rolled in the cartridge
$B$ = (a cross section area of the cartridge barrel) − (a cross sectional area of the spool).

12 Claims, 2 Drawing Sheets

PACKAGE OF PHOTOGRAPHIC LIGHT-SENSITIVE FILM

FIELD OF THE INVENTION

This invention relates to a package of a photographic light-sensitive film, or a photographic light-sensitive material in a form of film, and particularly to a package of a photographic light-sensitive film improved in core set curl which occurs in the film during storage, even when the free space ratio is lowered in the cartridge, so that the recovery properties from core set curling recovering ability or the residual core-set curl remaining after processing can be excellent. Hereinafter, photographic light-sensitive film is referred to simply a 'photographic film'.

BACKGROUND OF THE INVENTION

At present stage, a compact-sized camera has popularly been used on the general market. Taking the easiness thereof into consideration so as to make a camera portable, a compact-sized camera is so required as to make it more smaller in size than the current sizes. It is usual that a photographic film is rolled up and it is put in a cartridge and is then loaded into a compact-sized camera. It is the most effective means for pursuing a camera having a more compact size to make the cartridge space smaller inside a camera.

However, when a cartridge is made smaller in size, a photographic film has to be put in a cartridge having a small diameter. Therefore, it produces such a defect that the void ratio in the cartridge is reduced, so that the photographic film is liable to be core set curled. When a core set curl is increased, there raises such a problem that a film transport is stuck or a film is creased in a processing apparatus such as a splicer. There also raises such a problem that a core set curl cannot satisfactorily be remedied even after completing a development process, so that the handling of the subject film is worsened by the remaining core set curl. Further, increasing in core-set curl of photographic film raises a problem that the loading weight necessary for drawing out the photographic film from a cartridge and the film cannot be smoothly draw out from the cartridge when the free space ratio in the cartridge is small.

On the other hand, a technique is known in which the remediableness of a core set curl is improved by making a polyester support hydrophilic. Such technique is disclosed in Japanese Patent Publication Open to Public Inspection (hereinafter referred to as JP OPI Publication) Nos. 2-120857/1990 and 1-244446/1989; and a cartridge packaging system in which a polyester made hydrophilic is used, of which is given in JP OPI Publication No. 4-250446/1992. Even in the above-given processes, it has, however, been proved that the processes are not satisfactory when a void ratio is reduced in a cartridge, so that a core set curl may be increased and the remediableness of a core set curl may be deteriorated after completing a development process.

As mentioned above, with the advance of making smaller a package of a photographic film in size, a photographic light-sensitive material has been so required as to be excellent in core set roll resistance and in Core set roll remediableness, even in the case where a void ratio is reduced in a cartridge.

SUMMARY OF THE INVENTION

It is an object of the invention to provide a package of a photographic film so that any core set curl can hardly be produced and the remediableness of a core set curl can also be excellent so as to provide a compact-sized camera, even if a void ratio is reduced in a cartridge with the advance of making a cartridge smaller in size. Further, an object of the invention to provide a package of a photographic film, in which the film can be smoothly draw out from a cartridge if the free space ratio in the cartridge is small.

The package of a photographic light-sensitive film of the invention comprises a cartridge enclosing a spool and a stripe of a photographic light-sensitive film rolled on said spool. The cross sectional area of the cartridge is not larger than 370 $mm^2$ and the cross sectional area of the spool is not larger than 95 $mm^2$. In the cartridge, the percentage of free space V in the cartridge calculated by the following equations is not higher than 0.25. and the photographic light-sensitive film comprises a silver halide emulsion layer and a support comprising laminated two or more layers each composed of a polyester or a copolymeric polyester, respectively;

$$V=(B-A)/B$$

wherein $A$ = a cross sectional area of the light-sensitive film rolled in the cartridge
= Thickness × length of the light-sensitive film rolled in the cartridge
$B$ = (a cross sectional area of the cartridge barrel) − (a cross sectional area of the spool).

In the above, a cross-sectional area of a rolled film, a cross-sectional area inside a cartridge, a cross-sectional area of a cartridge barrel and a cross-sectional area of a spool means each an area of a cross-section intersecting perpendicularly to the spool core, that is, each of the areas of the cross-sections shown in FIG. 1.

Preferable embodiments of the invention are as follows:

(1) At least one of the layers of the support of the light-sensitive film comprises a copolymeric polyester containing an aromatic dicarboxylic acid having a metal sulfonate group and a polyalkylene glycol as copolymerized components.

(2) The support has a widthwise direction curling degree of $-5\ m^{-1}$ to $-135\ m^{-1}$.

(3) The support has asymmetry with respect to the plane which equally divides the thickness of the support.

(4) The support is composed of three laminated layers and thicknesses of the two outer layers dA and dB satisfy the following relation:

$$.1 \leqq dA/dB \leqq 5$$

The expression, "the widthwise direction of a support", mentioned above means the direction to be parallel to the axis direction of a spool when a light-sensitive material prepared by making use of the above-mentioned support is wound around the spool inside a package of the invention, that is, the direction indicated by W in FIG. 2. And, the expression, "the lengthwise direction" means the direction to be perpendicular to the direction of the core of a spool, that is, the direction indicated by L in FIG. 2. Hereinafter, all the expressions, "the widthwise direction" and "the lengthwise direction" will be made according to the above-mentioned definitions.

DETAILED DESCRIPTION OF THE INVENTION

Cartridge

Figure 2:
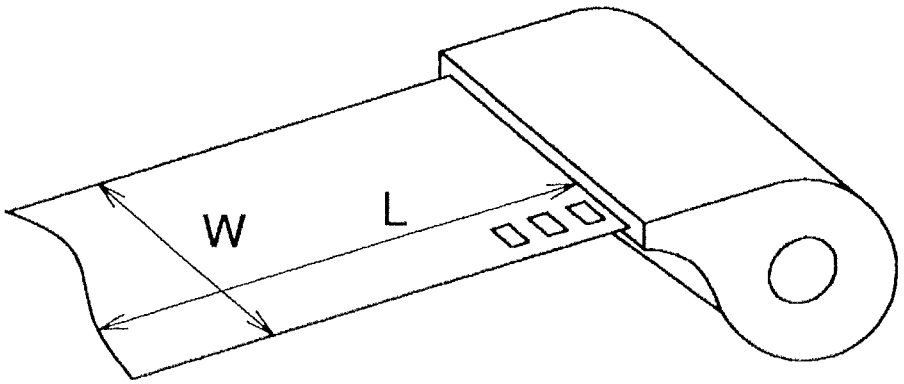
FIG. 2 is a drawing illustrating the direction of a light-sensitive material contained in a package.
Figure 1:
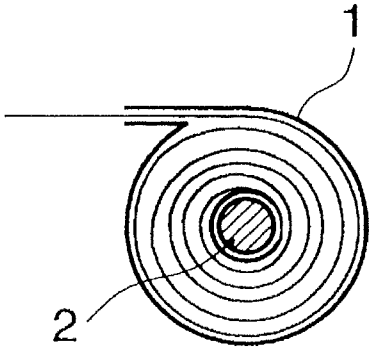
FIG. 1 is a cross-sectional view of a package, in which 1 is a cartridge and 2 is a spool.

In a photographic film package of the invention, a cartridge may have such a system being widely used at present that the leading end of a photographic film is pulled out in advance to the outside of the cartridge, or a cartridge may also have any photographic film packaging systems including, for example, such a system as described in U.S. Pat. Nos. 4,834,306, 4,846,418 and 4,832,275, in which the leading end of a photographic film is put inside a cartridge in advance and the film is then fed to the outside of the cartridge by rotating a spool having wound the film round in the direction reverse to the winding direction; provided that a cartridge can pack a photographic film in whole therein.

Inside a cartridge containing a photographic film therein, a free space that is represented by a free space ratio V defined by Formula (1).

$$V=(B-A)/B \quad (1)$$

wherein A represents a cross-sectional area of a film rolled in a cartridge, and B represents a cross-sectional area of the inside of a cartridge. A and B will be defined as follows.

A=(a thickness of photographic film)× (a film length of photographic film)

B=(a cross-sectional area of a cartridge barrel) −(a cross-sectional area of a spool)

Every unit used therein will be standardized in terms of mm, for example. Every dimension will be measured at 23° C. and 55%RH.

The thickness of light-sensitive material means a total thickness of a photographic film, that is, a total of the thicknesses of every component of a film, such as a support, an emulsion layer, a backing layer and so forth. Such a film thickness as mentioned above can be obtained by measuring the thicknesses at any desired 10 points through a contact type thickness tester, for example, an ELECTRONIC MICROMETER manufactured by ANRITSU Co., and then by taking an average thickness from the thicknesses measured.

A length of a photographic film means a length of a film portion housed in a cartridge. When a trailing end of a photographic film is inserted into a slit of a spool, the slit of the spool is regarded as the trailing end of the film.

The cross-sectional area of a cartridge barrel means an intracartridge cross-sectional area in the cross-section of a film portion housed in a cartridge, not in the upper end and lower end of the cartridge. When providing an extrusion or a rib to the inside of a cartridge, for the purpose of controlling a film position or for the purpose of improving the film slidableness, the cross-sectional area inside the extrusion is to be taken.

A cross-sectional area of a spool means a cross-sectional area of a portion of the spool where a photographic film is wound round.

Free space ratio V is to be $0<V\leqq 0.25$, preferably $0.04\leqq V\leqq 0.22$ and, most preferably $0.08\leqq V\leqq 0.19$.

For making a camera smaller in size, a cross-sectional area of a cartridge is to be not larger than 370 $mm^2$, preferably 150 to 370 $mm^2$ and, more preferably 188.6 to 285 $mm^2$. A cross-sectional area of a spool is to be not larger than 95 $mm^2$, preferably 15 to 95 $mm^2$, more preferably 33.2 to 90 $mm^2$, further preferably 33.2 to 80 $mm^2$.

In a cartridge, the slit for drawing out a photographic film may be shielded against light in any manner. It is allowed to provide a velvet-like light-shielding member and, in a system where the leading end of a photographic film is housed in a cartridge in advance, it is also allowed to use a slit through which the photographic film can be pulled, which can be opened and closed so that the slit can be kept closed except when the slit is required to be opened.

To a photographic film incorporated into a package of the invention, it is preferable to provide a backing layer to the side opposite to the side coated with an emulsion layer of a support comprising a transparent support and at least one light-sensitive silver halide emulsion layer coated thereon.

Support for photographic film

A support for photographic film of the invention has at least two layers each comprising a polyester or a copolymeric polyester.

Polyester

A polyester serving as a raw material for forming a polyester layer means those each comprising a repetition unit of dicarboxylic acid and diol as a principally constitutional component. They include, preferably, a polyester comprising a repeating unit of an aromatic dibasic acid and glycol as a principal component.

The above-mentioned dibasic acids include, for example, terephthalic acid, isophthalic acid and naphthalene dicarboxylic acid. The diol or glycol include, for example, ethylene glycol, propylene glycol, butanediol, neopentyl glycol, 1,4-cyclohexanedimethanol, diethylene glycol and p-xylene glycol. Among them, the preferable include, for example, polyethylene terephthalate comprising terephthalic acid and ethylene glycol as the principal component, and polyethylene-2,6-naphthalate derived from 2,6-naphthalene dicarboxylic acid and ethylene glycol as the principal component.

They may also be a copolymer having the above-mentioned repeating unit of not less than 85 mol % and preferably not less than 90 mol %, and they may further be blended with the other polymer.

A preferable intrinsic viscosity of a polyester shall not be limitative, but it is preferable to be within the range of 0.45 to 0.80 and particularly 0.55 to 0.70, from the viewpoint of the stretchability in preparing a multilayered film.

The intrinsic viscosity stated herein can be measured in the following manner.

A sample is dissolved in a solvent prepared by mixing phenol and 1,1,2,2-tetrachloroethane in a weight ratio of about 55:45, of which the falling flow time is controlled to be 4.2±0.1 seconds, thereby the solutions of the sample having a concentration of 0.2, 0.6 and 1.0 g/dl at 20° C. are each prepared, respectively. By making use of a Ubbelohde type viscometer, the specific viscosity ($\eta_{sp}$) of each solution is obtained from the concentration (C) thereof. Then, an extrapolation is so made as to be zero in concentration in accordance with the following formula to obtain the intrinsic viscosity of the sample. The unit of the intrinsic viscosity [η] is dl/g.

$$[\eta] = \lim_{C \to O} \frac{\eta_{sp}}{C}$$

After preparing the light-sensitive material, a silver halide emulsion layer and/or a gelatin backing layer each coated on the both sides of the support of a light-sensitive material are peeled off by making use of an aqueous solution of pancreatin or sodium hypochlorite. The remaining film, that is the support, is cut off. Even if the cut off film is evaluated, the same intrinsic viscosity can be obtained. Therefore, it is allowed that an intrinsic viscosity may be measured from a sample obtained by cutting each of the above-mentioned layers off, after preparing a light-sensitive material and the support thereof is then peeled off in the above-mentioned manner.

Copolymeric polyester

As a copolymeric polyester to form a copolymeric polyester layer of a support of the invention, a copolymeric polyester is preferably used, which is composed of repeating units derived from a dicarboxylic acid and a diol, preferably an aromatic dicarboxylic acid and a glycol, as principal constitution components, and further contains a repeating unit derived from a dicarboxylic acid having a metal sulfonate group as a copolymeric component. Further in the invention, a copolymeric polyester include also a blend of a copolymeric polyester and a polyester each mentioned above.

The above-mentioned dibasic acids include, for example, terephthalic acid, isophthalic acid and a naphthalene dicarboxylic acid. Glycols include, for example, ethylene glycol, propylene glycol, butanediol, neopentyl glycol, 1,4-cyclohexanedimethanol, diethylene glycol and p-xylene glycol. Among the copolymeric polyesters, a copolymeric polyethylene terephthalate comprising terephthalic acid and ethylene glycol each as a principal constitution component and a copolymeric polyethylene-2,6-naphthalate comprising 2,6-naphthalene dicarboxylic acid and ethylene glycol each as a principal constitution component are preferably used.

A preferable intrinsic viscosity of a copolymeric polyester shall not specially be limited, however, from the viewpoint of a stretchability in preparing a laminated support, it is preferable to be within the range of 0.35 to 0.75 and, particularly, 0.45 to 0.65.

An aromatic dicarboxylic acid having a metal sulfonate group, as a copolymerization component in a copolymeric polyester include, for example, 5-sodium sulfoisophthalic acid, 2-sodium sulfoterephthalic acid, 4-sodium sulfoterephthalic acid, 4-sodium sulfo-2,6-naphthalene dicarboxylic acid or an ester-formable derivative represented by the following chemical formula, and a compound substituted the above-mentioned sodium by another metal such as potassium and lithium.

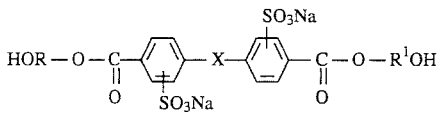

-continued

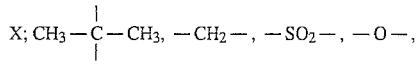

R, $R^1$; $-(CH_2)_n-$ (n = 2 to 10)

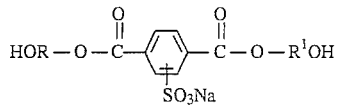

R, $R^1$: $-(CH_2)_n-$ .n = 2 to 10

The above-mentioned copolymeric polyesters are each preferable to contain a polyalkylene glycol and/or a saturated aliphatic dicarboxylic acid each as a copolymerization component, provided that the effects of the invention shall not be spoiled.

As for the above-mentioned polyalkylene glycol, polyethylene glycol, polytetramethylene glycol and the derivatives thereof may be used. Among them, a polyethylene glycol represented by Formula (a) is preferably used. The molecular weight thereof shall not specially be limited, however, they may preferably be used, when they have a number average molecular weight within the range of, preferably, 600 to 10000 and, particularly, 1000 to 5000.

$$H(O—CH_2CH_2)_n—OH \quad (a)$$

As a polyalkylene glycol, the same effects can also be obtained when making use of a polyethyleneoxy dicarboxylic acid such as represented by formula (b) in which the terminal —H of a polyethylene glycol is substituted by $—CH_2COOR$ (in which R represents H or an alkyl group having 1 to 10 carbon atoms, and n is a positive integer), a polyether dicarboxylic acid such as represented by formula (c), in which R' represents an alkylene group having 2 to 10 carbon atoms, and n is a positive integer, or the like.

$$ROOCCH_2—(O—CH_2CH_2)_n—OCH_2COOR \quad (b)$$

$$ROOCCH_2—(O—R')_n—OCH_2COOR \quad (c)$$

The molecular weights of the compounds represented by formulas (b) and (c) shall not especially be limited also, however, they may preferably be used, when they have a number average molecular weight within the range of, preferably, 600 to 10000 and, particularly, 1000 to 5000.

As for a saturated aliphatic dicarboxylic acid, the esterized derivatives thereof may preferably be used. For example, dimethyl adipate or dimethyl sebacate, which is an ester of adipic acid or sebacic acid, may be used. Among them, dimethyl adipate may preferably be used.

A copolymeric polyester applicable to the invention may further be copolymerized with the other components or may be blended with the other polymers; provided, the effects of the invention shall not be spoiled.

In both of a polyester and a copolymeric polyester each applicable to the invention, phosphoric acid, phosphorous acid, the esters thereof and an inorganic particle or such as particle of silica, kaolin, calcium carbonate, calcium phosphate, titanium dioxide may be contained in the polymerization stage, or a polymer may be blended with the inorganic particle after completing a polymerization. Further, a pigment, a UV absorbent, an antioxidant and/or the like may also be added thereto either in the polymerization stage or after completing the polymerization.

Preparation of polyester and copolymeric polyester A copolymeric polyester may be obtained by adding the above-mentioned copolymerization component after ester-exchanging an acid component and a glycol component and then by carrying out a polymerization with fusing, or it may be obtained by adding a copolymerization component before making an ester-exchange reaction and then by carrying out a polymerization with fusing after completing the ester-exchange reaction. Besides, it is allowed to use such a known synthesizing process that a polymer prepared by making a polymerization with fusing is polymerized in a solid phase.

As for a catalyst applicable to make the above-mentioned ester-exchange reaction, may be used a salt of metal such as manganese, calcium, zinc and cobalt with an acid such as acetic acid salt, aliphatic acid salt or carbonic acid. Among them, a hydrate of manganese acetate or calcium acetate is preferred and the mixtures thereof are more preferred. It is also effective that a hydroxide, a metallic salt of an aliphatic carboxylic acid or a quaternary ammonium salt is added when making the above-mentioned ester-exchange reaction and/or a polymerization; provided that any reaction cannot be spoiled or any polymer cannot be colored. Among them, sodium hydroxide, sodium acetate, tetraethylhydroxy ammonium and so forth are preferred and sodium acetate is particularly preferred.

Layer arrangement of support

As described above, a support of the invention comprises at least two layers each comprising a polyester or a copolymeric polyester. As for the layer arrangement, any one of the layers has a multilayered structure in which any desired numbers of the layers such as two, three or four layer are laminated to each other. The "layer" constituting a support of the invention is limited to that having a thickness of not thinner than 2 microns. A layer having a thickness of thinner than 2 microns, such as a sublayer, is not regarded as a "layer" constituting a film.

The above-mentioned support may contain phosphoric acid, phosphorous acid and the esters thereof, an inorganic particle such as those of silica, kaolin, calcium carbonate, calcium phosphate and titanium dioxide, and a variety of additives such as a matting agent, an antistatic agent, a lubricant, a surfactant, a stabilizer, a dispersant, a plasticizer, a UV absorbent, a conductive substance, a tackifier, a softener, a fluidizer, a thickener and an antioxidant.

It is preferable that the above-mentioned support contains a dye for the purpose of preventing a light-piping phenomenon or a edge-fog that is produced when a light is made incident from the edge of the support coated thereon with a silver halide emulsion layer. As for a dye compounded with the above-mentioned purpose, there is no special limitation to the kinds thereof, however, it is preferable to use a dye excellent in heat resistance from the viewpoint of a film-casting process and such a dye as mentioned above include, for example, an anthraquinone type chemical dye.

The color tone of a support is preferably in gray as is often seen on common photographic films. It is also allowed to use one or not less than two kinds of dyes mixed up together. As for the above-mentioned dyes, those including, for example, SUMIPLAST manufactured by Sumitomo Chemical Co. Ltd., Diaresin manufactured by Mitsubishi Chemical Co., Ltd., and MACROLEX manufactured by Bayer AG, may be used independently or in a suitable mixture thereof.

A support of the invention can be prepared in the following manner, for example. After well drying up the above-mentioned polyester or copolymeric polyester, it is fusedly extruded to be in the sheet-shaped through an extruder controlled to be within the temperature range of 260° to 330° C., a filter, a mouthpiece. The fused polymer extrusion is so cooled to be solidified on a rotating cooling drum, so that an unstretched film can be obtained. Thereafter, the unstretched film is biaxially stretched in the longitudinal and lateral directions and is then fixed with heating, so that the support of the invention is prepared.

The methods for biaxially stretching a film include, for example, the following methods (A) through (C).

(A) A method in which an unstretched film is stretched in the longitudinal direction first and is then stretched in the lateral direction;

(B) Another method in which an unstretched film is stretched in the lateral direction first and is then stretched in the longitudinal direction; and (C) A further method in which, after an unstretched film is stretched by either a single stage or a multiple stage in the longitudinal direction, the stretched film is stretched in the longitudinal direction again, and is then stretched in the lateral direction.

It is preferable to stretch a polyester film in an area ratio within the range of 4- to 16-fold so as to satisfy the mechanical strength and dimensional stability of a polyester support.

A support of the invention is formed in such a manner as mentioned above and has a multilayered structure in which a film or sheet made of the other material and a film or sheet formed in the above-mentioned method are laminated together in a co-extrusion method or a lamination method.

There is no special limitation to the thickness of a support. Therefore, any thickness thereof may be used according to the application, however, it is preferably not thicker than 125 μm, more preferably 50 to 115 μm and, particularly 65 to 100 μm.

Now, a curling of a support of the invention will be detailed below. The curling of a support means a curl or a curve a support has in itself. The degrees of a curl are represented by a 1/R in terms of a unit of $m^{-1}$ in which R represents a curvature radius of a curled film, of which a unit is m (or in meter). When a curl is produced toward an emulsion side, it is expressed by + (or a plus curl), and when it is produced toward a backing layer side, it is expressed by − (or a minus curl).

In the invention, it is preferable that a curl of a support is to be concave on the back side which is the side opposite to the side on which an emulsion layer is to be coated and the curl is to be concaved in the widthwise direction, that is, in the direction parallel to the direction of a spool core, when a package is completed. It is more preferable that a curvature is to be within the range of −5 to −35 $m^{-1}$ when represented by 1/R.

With a support, a curl produced in the widthwise direction may be measured in the following manner.

From a support, a sample is cut out to have a size of 35 mm by 2 mm, the former side is in the widthwise direction, that is, a direction to be parallel to the core of a spool when a film is rolled round the spool in a package of the invention, and the latter side is in the lengthwise direction perpendicular to the core of the spool in the package. The cut out sample is rehumidified for one day under the conditions of 23° C. and 55%RH and the resulting curvature degrees was then measured in the widthwise direction. In the measurement of curvature degrees, a group consisting of curvature rulers having various curvature radii are provided a curled sample is measured with a ruler having the closest curvature $m^{-1}$ and the obtained curvature is regarded as the curvature of the sample.

For providing a support of the invention with a curl to the widthwise direction in advance in the case that a film has a double layer-laminated structure, the double layer-laminated structure is comprised of at least two polyester or copolymeric polyester layers. In the two layers of the layer-laminated film, it is preferable when the kinds of the polyesters or copolymeric polyesters thereof are different between the layers in each amount of the principal components, or in the copolymerization components or each amount of the copolymerization components. For example, the layers may also be comprised of a polyester layer and a copolymeric polyester layer or a copolymeric polyester layer and the other copolymeric polyester layer having a different composition. As a copolymeric component, an aromatic dicarboxylic acid having a metal sulfonate group is preferably contained therein. It is also preferable that a polyalkylene glycol and/or a saturated aliphatic dicarboxylic acid are contained therein. In this case, as a copolymerization component in a copolymeric polyester applicable thereto, it is particularly preferable that an aromatic dicarboxylic acid having a metal sulfonate group is contained therein in a proportion of 2 to 7 mol % of the whole ester linkage and that a polyalkylene glycol and/or a saturated aliphatic dicarboxylic acid, as a copolymerization component thereof, is contained in a proportion of 2 to 10 wt % of the whole weight of the copolymerization components thereof. In the case of a double layer-laminated structure, a curl may be provided to the widthwise direction of the laminated film by suitably controlling the above-mentioned items.

In the case of a three-layer laminated structure, it is preferable that the two outer layers are each comprised of a polyester or a copolymeric polyester. However, the middle layer may be comprised of a polyester, a copolymeric polyester or the other materials such as a polycarbonate, polyether, polyamide, polyimide, polyphthalamide and polyphthalimide, to which there is no special limitation; provided that the effects of the invention shall not be spoiled. Among them, it is preferable when all the three layers are each comprised of a combination of a polyester layer and a copolymeric polyester layer and, particularly when the two outer layers are each comprised of a copolymeric polyester and the middle layer is comprised of a polyester. In a preferable embodiment of a support in the case of the three-layer laminated structure, the thicknesses of the outer layers are different from each other. When the thicknesses of the outer layers are indicated by $D_A$ and $d_B$ in the order from the thicker layer, respectively, the layer thickness ratio thereof is in the relation of, preferably $1.1 \leqq d_A/d_B \leqq 5$ and, particularly $1.3 \leqq d_A/d_B \leqq 3$. In another preferable embodiment of the three-layer laminated structure, the thicknesses of the outer layers may be the same width or different from each other. However, the kinds of a polyester or a copolymeric polyester of the two layers which are the outer layers of the layer-laminated support are different between them, for example, in the principal constitution component and the amount thereof and also in the intrinsic viscosity. In the above-mentioned case, as the copolymerization components contained in a copolymeric polyester applicable thereto, it is particularly preferable that an aromatic dicarboxylic acid having a metal sulfonate group is contained in a proportion of 2 to 7 mol % of the whole ester linkage and, as the copolymerization components', it is also particularly preferable that a polyalkylene glycol and/or a saturated aliphatic dicarboxylic acid are contained in a proportion of 3 to 10 wt % of the whole weight of the copolymerization components. In the case of a support is comprised of a three-layer laminated structure, a curl can be provided to the widthwise direction of the laminated film by suitably controlling the above-mentioned items. A difference $\Delta V$ between the intrinsic viscosities is to be within the range of 0.02 to 0.5, preferably 0.05 to 0.4 and, particularly 0.1 to 0.3.

In other words, in a support applicable to the invention and even if the numbers of the component layers thereof are two, three or not less than four layers, it is preferable for providing a widthwise curl that the layer arrangement is to be asymmetrical with respect to the upper and lower sides of the plane where the whole thickness of the support can be halved.

The expression, "asymmetry", herein means, for example; that a polyester layer, a copolymeric polyester layer and each layer comprising the other materials are different in the arrangement order thereof, the layer thicknesses and the principal constitution component amount thereof on the upper and lower sides of the plane halving thickness of a support; and that the copolymerization components or the amounts thereof are different from each other layer; and, in addition, the asymmetry further include such a meaning that the intrinsic viscosities of the components are different from each other.

In the methods for determining the asymmetry of these layer-laminated film, a variety of analyzing apparatuses may be used and there is no special limitation thereto. However, a layer arrangement may be measured by microscopically observing the cross-section of a subject film or by microscopically photographing it. While microscopically observing the film, each layer is scraped off or each layer is scraped off to the position of a plane halving the film from the upper and lower sides, so as to obtain the analyzing subjects of the upper and lower layer. The resulting analyzing subjects are hydrolyzed and are then measured through one of various types of measuring apparatuses such as a liquid chromatography or an NMR; or, after dissolving an analyzing subject in a solvent, the intrinsic Viscosity thereof may be measured through an NMR, GPC (or a gel-permeation chromatography) or the like. Also, the measurement may be carried out in such a manner that an analyzing subject remaining powdered is measured through an X-ray spectroscope, or the mixture thereof with KBr or the like is measured through an IR (or an infrared spectroscope). As the results thereof, an asymmetry may also be determined from an absolute measurement value or the difference of the peak positions or the intensity value each equivalent to the above-mentioned absolute value.

When a support of the invention has a double layer-laminated structure consisting of a polyester layer and a copolymeric polyester layer, a widthwise concave curl is usually produced on the copolymeric polyester layer side. When a double layer-laminated structure consists of two copolymeric polyester layers, a widthwise curl can be controlled by suitably controlling the layer thicknesses and layer compositions. In the case of a three-layer laminated structure, that is, when a copolymeric polyester layer is arranged as outer layers, a widthwise concave curl may usually be provided to the foregoing dA side. In the case where a copolymeric polyester layer is on an inner layer and polyester layers are on outer layers, a widthwise concave curl may usually be provided to the dB side. Even if a support of the invention consists of two, three or not less than four layers, there shall not be limited thereto, but a widthwise curl can be provided by suitably controlling the foregoing items such as the layer arrangements, the layer thicknesses and the amounts of the copolymerization components.

Silver halide emulsion layer

A silver halide emulsion layer can be formed in the following manner. A silver halide emulsion containing a silver halide and other components is coated directly or indirectly on one of the surfaces of a support of the invention or the both surfaces thereof, in any one of a variety of coating processes.

The above-mentioned silver halide emulsion may be coated directly on a support of the invention, or may also be coated thereon through the other layers such as a hydrophilic colloidal layer containing no silver halide emulsion. Further on the silver halide emulsion layer, a hydrophilic colloidal layer may also be coated as a protective layer. It may be also to coat each of silver halide emulsion layers different in photosensitive speeds, for example, it is allowed to separate a silver halide emulsion layer into one having a relatively higher photosensitive speed and the other having a relatively lower photosensitive speed. In this case, an intermediate layer may also be interposed between each of the silver halide emulsion layers. It is further allowed to interpose such a non-light-sensitive hydrophilic colloidal layer as an intermediate layer, a protective layer, an antihalation layer and a backing layer, between a silver halide emulsion layer and a protective layer.

Silver halides having any compositions are applicable to the silver halide emulsions. They include, for example, silver chloride, silver chlorobromide, silver chloroiodobromide, pure silver bromide or silver iodobromide.

The above-mentioned silver halide emulsion may contain a binder, a sensitizing dye, a plasticizer, an antistatic agent, a surfactant, a layer hardener and other components.

The methods of coating the above-mentioned silver halide emulsion layers include a variety of methods such as a dip-coating method, an air-knife coating method, a curtain coating method and an extrusion coating method. The coating operation may be performed by a single-layer coating or by a simultaneous multilayer coating.

In an emulsion layer, a content of a hydrophilic colloid is in a proportion within the range of 0.5 to 30 g/m$^2$.

Backing layer

A backing layer may be formed in the following manner. A coating solution containing gelatin and other components is coated on a single or plural layers provided to one side of a support opposite to the other side on which a silver halide emulsion layer is formed.

In the invention, the outermost layer of the above-mentioned backing layer may also contain a fluorine type anionic surfactant and a fluorine type cationic surfactant.

The above-mentioned gelatin applicable thereto also include, for example, lime-treated gelatin, acid-treated gelatin, alkali-treated gelatin and gelatin induced from a hydrolysate, an enzyme-decomposite or other gelatin.

A backing layer applicable to the invention may also contain such a compound as has been well-known, as the other components, including, for example, a hydrophilic colloid, a matting agent, a lubricant, a surfactant, a layer hardener, a dye, a thickener and a polymer latex.

The above-mentioned hydrophilic colloids include, for example, a compound having characteristics similar to those of gelatin such as a natural or synthetic hydrophilic polymer. In a backing layer, there is no special limitation to the contents of such a hydrophilic colloid as mentioned above, however, the contents thereof are preferably within the range of 0.1 to 15 g/m$^2$.

As for the above-mentioned matting agent, a lubricant, a surfactant and a layer hardener, it is allowed to make use of the compounds described in, for example, Research Disclosure No. 17643 (1978), paragraphs XVI, XII, XI and X.

Taking the thickness of the whole light-sensitive material, the prevention of a reverse curling and a curling balance into consideration, the thickness of a backing layer in the invention is commonly within the range of 0.5 to 15 μm and, preferably, 2 to 10 μm. It is also allowed that such a backing layer as mentioned above may be formed of not less than two kinds of layer.

In the invention a magnetic recording layer may be provided to a backing layer of the invention. The fine magnetic powders applicable to a magnetic recording layer include, for example, magnetic metal powder, magnetic iron oxide powder, magnetic Co-doped iron oxide powder, magnetic chromium dioxide powder and magnetic barium ferrite powder.

The processes for preparing the above-mentioned magnetic powder have already been known. A magnetic powder applicable to the invention can be prepared in accordance with any already-known process.

There is no special limitation to the configurations and sizes of a magnetic powder and, therefore, they may widely be used. The configurations thereof may be any one of, for example, the needle-shaped, rice grain-shaped, cubic-shaped and tabular-shaped. However, the needle-shaped and tabular-shaped are preferable from the viewpoint of an electromagnetic conversion characteristics. There is also no special limitation to both of a crystallite size and a specific surface area. A magnetic powder may be surface-treated. For example, they may also be treated either with a substance containing such an element as titanium, silicone or aluminium or with an organic compound including, for example, an adsorptive compound having a nitrogen-containing heterocyclic ring such as those of carboxylic acid, sulfonic acid, a sulfate, phosphoric acid, a phosphate and benzotriazole. Further, there is no special limitation to a pH of a magnetic powder, however, it is preferable to be within the range of 5 to 10.

The above-mentioned magnetic metal powder include, for example, those in which a metal content is not less than 75 wt %, a content of a ferromagnetic metal or an alloy, such as Fe, Co, Ni, Fe—Co, Fe—Ni, Co—Ni and Co—Fe—Ni, is not less than 80 wt % of the metal content, and a content of other components such as Al, Si, S, Sc, Ti, V, Cr, Mn, Cu, Zn, Y, Mo, Rh, Pd, Ag, Sn, Sb, B, Ba, Ta, W, Re, Au, Hg, Pb, P, La, Ce, Pr, Nd, Te and Bi, is not more than 20 wt % of the metal content of the powder. The above-mentioned ferromagnetic metal content may further contain a small amount of a hydroxide or an oxide.

The above-mentioned magnetic iron oxide powder include, for example, γ-iron oxide. In iron oxide, a ratio of divalent iron to tervalent iron may be applied without any special limitation.

The above-mentioned magnetic recording layers are described in JP OPI Publication Nos. 47-32812/1972 and 53-109604/1978.

The sizes of magnetic particles have a correlation between the sizes and the transparencies thereof. This fact is described in the literature, "The characteristics of an extra-fine particulated semi-transparent magnetic recording medium and the practical application" appeared "Television", Vol. 20, No. 2. In a needle-shaped $\gamma$-$Fe_2O_3$ powder, for example, the light transmittance thereof may be improved when making a particle size smaller.

U.S. Pat. No. 2,950,971 describes that infrared rays are transmitted through a magnetic layer comprising magnetic iron oxide dispersed in a binder. U.S. Pat. No. 4,279,945 describes that a transmittance of He—Ne laser beam having a wavelength of 632.8 nm may be improved when making a particle size smaller, even when a concentration of magnetic particles is relatively increased inside a magnetic layer.

However, when providing a magnetic recording layer to an image-forming region of a silver halide photographic light-sensitive material, the light transmittance is to be higher in not only the red region but also in the green region and blue region.

For making the light transmittance in the red, green and blue regions, the particle sizes of magnetic particles are to be made smaller and, at the same time, the coating amount of the magnetic particles are also limited.

If the particle size of a magnetic particle is made smaller beyond some extent, any necessary magnetic characteristics may not be obtained. Therefore, it is preferable to make a magnetic powder size smaller to be within the range capable of obtaining the necessary magnetic characteristics. When the coating amount of magnetic particles is reduced beyond some extent, any necessary magnetic characteristics may not also obtained. It is, therefore, preferable to reduce the coating amount to be within the range capable of obtaining the necessary magnetic characteristics.

A coating amount of magnetic powder is practically within the range of 0.001 to 3 $g/m^2$ and, preferably, 0.01 to 1 $g/m^2$.

A binder applicable to a magnetic recording layer include, for example, a thermoplastic resin, a radiation-ray setting resin, a thermosetting resin, other reactive type resin and the mixtures thereof, which have so far been well-known as a binder for a magnetic recording medium use.

The above-mentioned thermoplastic resins include, for example; a vinyl type polymer or copolymer such as a vinyl chloride-vinyl acetate copolymer, a vinyl chloride resin, a vinyl acetate-vinyl alcohol copolymer, a vinyl chloride-vinylidene chloride copolymer, a vinyl chloride-acrylonitrile copolymer, an ethylene-vinyl alcohol copolymer, a chlorinated polyvinyl chloride, an ethylene-vinyl chloride copolymer and an ethylene-vinyl acetate copolymer; a cellulose derivative such as nitrocellulose, cellulose acetate propionate and a cellulose acetate butyrate resin; a gum-type resin such as a maleic acid and/or acrylic acid copolymer, an acrylonitrile-styrene copolymer, chlorinated polyethylene, an acrylonitrile-chlorinated polyethylene-styrene copolymer, a methyl methacrylate-butadiene-styrene copolymer, an acrylic resin, a polyvinyl acetal resin, a polyvinyl butyral resin, a polyester polyurethane resin, a polyether polyurethane resin, a polycarbonate polyurethane resin, a polyester resin, a polyether resin, a polyamido resin, an amino resin, a styrene-butadiene resin and a butadiene-acrylonitrile resin; a silicone type resin; and a fluororesin.

The above-mentioned thermoplastic resin has a Tg within the range of −40° C. to 150° C. and, preferably, 60° C. to 120° C. The weight average molecular weight thereof is to be within the range of, preferably 10,000 to 300,000 and, more preferably 50,000 to 200,000.

The above-mentioned radiation-setting resins means those capable of being set by such a radioactive rays as electron beam and UV rays. They include, for example, those of the anhydrous maleic acid type, urethane acryl type, ether acryl type and epoxy acryl type.

The thermosetting resins and other reactive type resins include, for example, a phenol resin, an epoxy resin, a setting type polyurethane resin, a urea resin, an alkyd resin and a setting type silicone resin.

The above-listed binders may also have a polar group in the molecules thereof. Such a polar group as mentioned above includes, for example, an epoxy group, —COOM, —OH, —$NR_2$, —$NR_3X$, —$SO_3M$, —$OSO_3M$, —$PO_3M_2$ and —$OPO_3M$, in which M represents a hydrogen atom, an alkali-metal or ammonium, X represents an acid capable of forming an amine salt, and R represents a hydrogen atom or an alkyl group.

The binders of a magnetic recording layer of the invention may also be applied with a hydrophilic binder.

The above-mentioned hydrophilic binders applicable to the magnetic recording layer include, for example, the water-soluble polymers, cellulose ether, latex polymers and water-soluble polyesters, of which are described in Research Disclosure No. 17643, p. 26 and, ibid., No. 18716, p. 651.

The above-mentioned water-soluble polymers include, for example, gelatin, a gelatin derivative, casein, agar-agar, sodium alginate, starch, a polyvinyl alcohol, an acrylic acid type copolymer and an anhydrous maleic acid copolymer. The cellulose ether include, for example, carboxymethyl cellulose and hydroxyethyl cellulose. The latex polymers include, for example, such a latex as a vinyl chloride type copolymer, a vinylidene chloride type copolymer, an acrylate type copolymer, a vinyl acetate type copolymer and a butadiene type copolymer. Among them, gelatin is most preferable.

Gelatin may be either non-modified or modified. A part of gelatin may be substituted by, for example, colloidal albumin, casein, a cellulose derivative such as carboxymethyl cellulose or hydroxyethyl cellulose, a sugar derivative such as agar-agar, sodium alginate, a starch derivative or dextran, a synthetic hydrophilic colloid such as polyvinyl alcohol, poly N-vinyl pyrrolidone, an acrylic acid copolymer and polyacrylamide or the derivatives thereof, a partial hydrolysate and a gelatin derivative.

A hydrophilic binder containing gelatin is preferable to be layer-hardened. For the layer-hardeners, any well-known layer-hardeners commonly applicable to harden a hydrophilic binder of a photographic light-sensitive material.

A layer-hardener is commonly used in a proportion within the range of 0.01 to 30 wt % of a dried gelatin and, preferably, 0.05 to 20 wt % thereof.

A magnetic powder is dispersed in a binder by making use of a solvent, if required, so that a coating solution can be prepared. For dispersing a magnetic powder, a ball-mill, a homomixer, a sand-mill and so forth may be used for. In this case, it is preferable that the magnetic particles are dispersed every one apart from the others as separatory as possible, without damaging the magnetic particles.

When forming an optically transparent magnetic recording layer, a binder may be used in a proportion within the range of, preferably 1 to 20 parts by weight to one part by weight of a magnetic powder used therein and, more preferably 2 to 15 parts by weight thereof. The solvent may be used in such an amount as a coating operation may easily be performed As for the processes for providing a magnetic recording layer to a support, an air-doctor coating process, a blade coating process, an air-knife coating process, a squeeze coating process, an impregnation coating process, a reverse-roll coating process, a transfer-roll coating process, a gravure coating process, a kiss coating process, a cast coating process and a spray coating process may each be utilized. For performing a multi-stripe coating, a series of the multiple coating heads for the above-mentioned process may be used for. The concrete stripe-coating processes may be referred to, for example, the descriptions thereof given in JP OPI Publication Nos. 48-25503/1973, 48-25504/1973, 48-98803/1973, 50-138037/1975, 52-15533/1977, 51-3208/1976, 51-6239/1976, 51-65606/1976 and 51-140703/1976, JP Examined Publication No. 29-4221/1954, and U.S. Pat. Nos. 3,062,181 and 3,227,165, respectively.

For solidly fixing the above-mentioned magnetic recording layer to a support, a sublayer may be provided to the support, or the support may be subjected to such a surface active treatment as a chemical treatment, a mechanical treatment, a corona-discharge treatment, a flame treatment, a UV ray treatment, a high-frequency treatment, a grow-discharge treatment, an active-plasma treatment a laser treatment, a conc-acid treatment and an ozone-oxidation treatment. Besides, a sublayer may also be provided after completing the above-mentioned surface active treatment.

The thickness of a magnetic recording layer is to be within the range of, preferably 0.1 to 10 μm, more preferably 0.2 to 5 μm and, particularly 0.5 to 3 μm.

A coating solution for forming a magnetic recording layer may also be added by a variety of additives such as a lubricant and an antistatic agent so as to provide the coated layer with a lubricity providing function, an antistatic function, an antiadhesion function, a function of improving an antifriction.abrasion resistive property. Besides the above additives, a coating solution may further be added by, for example, a plasticizer for providing a magnetic recording layer with softness, a dispersant for assisting the dispersion of magnetic particles in the coating solution and an abrasive for preventing a magnetic head from being clogged, respectively.

The above-mentioned lubricants include, for example, silicone oil such as polysiloxane oil, a fine plastic powder such as those of polyethylene or polytetrafluoroethylene, a higher aliphatic acid, a higher aliphatic acid ester and a fluorocarbon. They may be used independently or in combination. They may be added in a proportion within the range of 0.2 to 20 parts by weight to 100 parts by weight of a binder used.

The above-mentioned abrasives include, for example, non-magnetic inorganic powder having a Moh's hardness of not softer than 5 and preferably not softer than 6. They include, concretely; an oxide such as an aluminium oxide (e.g., α-alumina, γ-alumina and corundum); an oxide such as chromium oxide ($Cr_2O_3$), iron oxide ($\alpha$-$Fe_2O_3$), silicon dioxide and titanium dioxide; and a fine powder such as those of diamonds. The average particle size thereof is preferable to be within the range of 0.05 to 1.0 μm. They may be added in a proportion within the range of 0.5 to 20 parts by weight to 100 parts by weight of magnetic powder used.

If required, it is also allowed to provide a layer adjacent to a magnetic recording layer with a layer for assisting an adhesion to another layer, or a damage resistance may be improved by providing a protective layer to be adjacent to a magnetic recording layer.

For providing a damage resistance, a compound having generally been known as a lubricant may be used for. Such a compound as mentioned above include, preferably, a higher aliphatic acid ester. When providing a magnetic recording layer to be in the stripe-form, a transparent polymer layer not containing any magnetic particles is provided thereon, so that a level difference produced by a magnetic layer may be eliminated. When this is the case, it is also allowed to provide the above-mentioned transparent polymer layer with the above-mentioned various functions.

Development of silver halide photographic film

For developing a silver halide photographic light-sensitive material relating to the invention, any developers having been well-known by themselves can be used. Those well-known developers include, for example, those described in T. H. James, "The Theory of The Photographic Process", Fourth edition, pp. 291–334, and "Journal of the American Chemical society", Vol. 73, p.3,100, (1951).

EXAMPLES

EXAMPLE 1

A. Preparation of Support

Preparation of Support 1

To a mixture of dimethyl terephthalate of 100 parts by weight and ethylene glycol of 64 parts by weight, calcium acetate hydrate of 0.1 parts by weight was added as an ester-exchange catalyst and an ester-exchange reaction was then made in an ordinary process.

To the resulting product, 28 parts by weight of an ethylene glycol solution containing isophthalic acid in a concentration of 35 wt % and 8.1 parts by weight of polyethylene glycol having a number average molecular weight of 3000 were each added, and then 0.05 parts by weight of antimony trioxide, 0.13 parts by weight of trimethyl phosphate, 0.2 parts by weight of Irganox 1010 manufactured by CIBA-GEIGY AG. as an antioxidant and 0.02 parts by weight of sodium hydroxide were added. Successively, the temperature was raised and the pressure was reduced, each gradually, and a polymerization was carried out under the conditions at 280° C. and 0.5 mmHg, so that a copolymerized polyester $M_1$ having an intrinsic viscosity of 0.55 was obtained therefrom.

After the above-mentioned copolymerized polyester $M_1$ was vacuum-dried at 150° C., it was fusedly extruded at 285° C. by making use of an extruder and was then so quenched as to be solidified on a cooling drum, so that an unstretched polyester film could be prepared. The resulting unstretched film was stretched at 85° C. to be 3.5 times longer in the longitudinal direction and was then stretched at 95° C. to be 3.5 times wider in the lateral direction. After that, it was heatedly fixed up at 210° C., so that a 90 μm-thick support 1 was prepared.

Preparation of Support 2

By making use of the above-mentioned copolymerized polyester ($M_1$) and polyethylene terephthalate (P) for photographic use having an intrinsic viscosity of 0.65, that was to be served as a polyester layer, a support for photographic use was prepared in the following manner.

After vacuum-drying each of copolymerized polyester ($M_1$) and polyethylene terephthalate (P) at 150° C., each of them was fusedly extruded at 285° C. by making use of three units of extruder, and the resulting extruded matters were made adhered layerwise to each other inside a T die in the thickness ratio of copolymerized polyester ($M_1$)/polyethylene terephthalate (P)/copolymerized polyester ($M_1$) so that the layers could be arranged as shown in Table 2. The resulting layers were so quenched as to be solidified, so that an unstretched polyester-laminated film could be prepared. After the resulting unstretched laminated film was stretched at 85° C. to be 3.5 times longer in the longitudinal direction and was then stretched at 95° C. to be 3.5 times wider in the lateral direction, the stretched film was heatedly fixed up, so that a 90 μm-thick support 2 was prepared.

Preparation of Supports 3 through 5

Supports 3 through 5 were prepared in the same manner as in the preparation of support 2, except that the thickness ratio of the copolymerized polyester/the polyethylene terephthalate/the copolymerized polyester was so altered as to provide the layer arrangements shown in Table 2.

B. Preparation of photographic film

With each of the above-mentioned polyester film supports 1 through 5, both sides thereof were corona-discharged with 8 W/($m^2$-min.). On one side thereof was coated with the following subbing solution B-3 so as to have a dried layer thickness of 0.8 μm, so that subbing layer B-3 could be formed. On the other side thereof was coated with the following subbing solution B-4 so as to have a dried layer thickness of 0.8 μm, so that subbing layer B-4 was formed.

| | |
|---|---|
| <Subbing solution B-3> | |
| A latex having a solid content of 30%, of copolymer composed of 30 wt % of butyl acrylate, 20 wt % of t-butyl acrylate, 25 wt % of styrene and 25 wt % of 2-hydroxyethyl acrylate | 270 g |
| Compound (UL-1) | 0.6 g |
| Hexamethylene-1,6-bis(ethylene urea) | 0.8 g |
| Finish up to add water to make | 1000 ml |
| <Subbing solution B-4> | |
| A latex having a solfd content of 30%, of copolymer composed of 40 wt % of butyl acrylate, 20 wt % of styrene and 40 wt % of glycidyl acrylate | 270 g |
| Compound (UL-1) | 0.6 g |
| Hexamethylene-1,6-bis(ethylene urea) | 0.8 g |
| Add water to make | 1000 ml |

Further, subbing layers B-3 and B-4 were each corona-discharged thereon with 8 W/($m^2$-min.). Over sublayer B-3, the following coating solution B-5 was so coated as to have a dried layer thickness of 0.1 μm, so that subbing layer B-5 could be formed. Over sublayer B-4, the following coating solution B-5 was so coated as to have a dried layer thickness of 0.8 μm, so that subbing layer B-6 having an antistatic function was be formed.

| | |
|---|---|
| <Coating solution B-5> | |
| Gelatin | 10 g |
| Compound (UL-1) | 0.2 g |
| Compound (UL-2) | 0.2 g |
| Compound (UL-3) | 0.1 g |
| Silica particles having an average particle size of 3 μm | 0.1 g |
| Add water to make | 1000 ml |
| <Coating solution B-6> | |
| Water-soluble conductive polymer (UL-4) | 60 g |
| A latex solution comprising compound (UL-5) having a solid content of 20% | 80 g |
| Ammonium sulfate | 0.5 g |
| Hardener (UL-6) | 12 g |
| Polyethylene glycol (having a weight average molecular weight of 600) | 6 g |
| Add water to make | 1000 ml |

The structures of compounds (UL-1 through UL-6) used therein will be shown collectively hereafter.

On the above-mentioned subbing layers B-5 and B-6 were corona-discharged with 25 W/($m^2$-min.) and 8 W/($m^2$.min.), respectively. Further, the following emulsion layers and so forth were formed one upon another on the surface of the foregoing sublayer B-5 and the following backing layer was formed on sublayer B-6, respectively, so that a silver halide photographic light-sensitive material was prepared. The whole thickness of the silver halide photographic light-sensitive material was proved to be 122μ.

In the following recipes of the backing layer and emulsion layer the amounts of the components will be expressed in terms of an amount per $m^2$.

| | |
|---|---|
| <Backing layer> | |
| Layer 1: | |
| Gelatin | 4.5 g |
| Sodium-di-(-2-ethylhexyl)-sulfosuccinate | 1.0 g |
| Sodium tripolyphosphate | 76 mg |
| Citric acid | 16 mg |
| Carboxyalkyl dextran sulfate | 49 mg |
| Vinyl sulfone type hardener | 23 mg |
| Layer 2 (the outermost layer) | |
| Gelatin | 1.5 g |
| Polymer beads (made of polymethyl methacrylate having an average bead size of 3 μm) | 24 mg |
| Sodium-di-(-2-ethylhexyl)-sulfosuccinate | 15 mg |
| Carboxyalkyl dextran sulfate | 12 mg |
| Vinyl sulfone type layer hardener | 30 mg |
| A mixture of fluorine type anionic surfactant (compound FA-1) and fluorine type cationic surfactant (compound FK-1) (in a mol ratio of 1:1) | 20 mg |
| Compound (compound A) | 250 mg |
| <Emulsion layer> | |
| Layer 1: Antihalation layer (HC) | |
| Black colloidal silver | 0.15 g |
| UV absorbent (UV-1) | 0.20 g |
| Compound (CC-1) | 0.02 g |
| High-boiling solvent (Oil-1) | 0.20 g |
| High-boiling solvent (Oil-2) | 0.20 g |
| Gelatin | 1.6 g |
| Layer 2: Interlayer (IL-1) | |
| Gelatin | 1.3 g |

-continued

| | |
|---|---|
| Layer 3: Low-speed red-sensitive emulsion layer (RL) | |
| A silver iodobromide emulsion having an average grain size of 0.3 μm and an average iodine content of 2.0 mol % | 0.4 g |
| A silver iodobromide emulsion having an average grain size of 0.4 μm and an average iodine content of 8.0 mol % | 0.3 g |
| Sensitizing dye (S-1) | $3.2 \times 10^{-4}$ mol/Ag mol |
| Sensitizing dye (S-2) | $3.2 \times 10^{-4}$ mol/Ag mol |
| Sensitizing dye (S-3) | $0.2 \times 10^{-4}$ mol/Ag mol |
| Cyan coupler (C-1) | 0.50 g |
| Cyan coupler (C-2) | 0.13 g |
| Colored cyan coupler (CC-1) | 0.07 g |
| DIR compound (D-1) | 0.006 g |
| DIR compound (D-2) | 0.01 g |
| High-boiling solvent (Oil-1) | 0.55 g |
| Gelatin | 1.0 g |
| Layer 4: High-speed red-sensitive emulsion layer (RH) | |
| A silver iodobromide emulsion having an average grain size of 0.7 μm and an average iodine content of 7.5 mol % | 0.9 g |
| Sensitizing dye (S-1) | $1.7 \times 10^{-4}$ mol/Ag mol |
| Sensitizing dye (S-2) | $1.6 \times 10^{-4}$ mol/Ag mol |
| Sensitizing dye (S-3) | $0.1 \times 10^{-4}$ mol/Ag mol |
| Cyan coupler (C-2) | 0.23 g |
| Colored cyan coupler (CC-1) | 0.03 g |
| DIR compound (D-2) | 0.02 g |
| High-boiling solvent (Oil-1) | 0.25 g |
| Gelatin | 1.0 g |
| Layer 5: Interlayer (IL-2) | |
| Gelatin | 0.8 g |
| Layer 6: Low-speed green-sensitive emulsion layer (GL) | |
| A silver iodobromide emulsion having an, average grain size of 0.4 μm and an average iodine content of 8:0 mol % | 0.6 g |
| A silver iodobromide emulsion having an average grain size of 0.3 μm and an average iodine content of 2.0 mol % | 0.2 g |
| Sensitizing dye (S-4) | $6.7 \times 10^{-4}$ mol/Ag mol |
| Sensitizing dye (S-5) | $0.8 \times 10^{-4}$ mol/Ag mol |
| Magenta coupler (M-1) | 0.17 g |
| Magenta coupler (M-2) | 0.43 g |
| Colored magenta coupler (CM-1) | 0.10 g |
| DIR compound (D-3) | 0.02 g |
| High-boiling solvent (Oil-2) | 0.7 g |
| Gelatin | 1.0 g |
| Layer 7: High-speed green-sensitive emulsion layer (GH) | |
| A silver iodobromide emulsion having an average grain size of 0.7 μm and an average iodine content of 7.5 mol % | 0.9 g |
| Sensitizing dye (S-6) | $1.1 \times 10^{-4}$ mol/Ag mol |
| Sensitizing dye (S-7) | $2.0 \times 10^{-4}$ mol/Ag mol |
| Sensitizing dye (S-8) | $0.3 \times 10^{-4}$ mol/Ag mol |
| Magenta coupler (M-1) | 0.30 g |
| Magenta coupler (M-2) | 0.13 g |
| Colored cyan coupler (CM-1) | 0.04 g |
| DIR compound (D-3) | 0.004 g |
| High-boiling solvent (Oil-2) | 0.35 g |

-continued

| | |
|---|---|
| Gelatin | 1.0 g |
| Layer 8: Yellow filter layer (YC) | |
| Yellow colloidal silver | 0.1 g |
| Additive (HS-1) | 0.07 g |
| Additive (HS-2) | 0.07 g |
| Additive (SC-1) | 0.12 g |
| High-boiling solvent (Oil-2) | 0.15 g |
| Gelatin | 1.0 g |
| Layer 9: Low-speed blue-sensitive emulsion layer (BL) | |
| A Silver iodobromide emulsion having an average grain size of 0.3 μm and an average iodine content of 2.0 mol % | 0.25 g |
| A silver iodobromide emulsion having an average grain size of 0.4 μm and an average iodine content of 8.0 mol % | 0.25 g |
| Sensitizing dye (S-9) | $5.8 \times 10^{-4}$ mol/Ag mol |
| Yellow coupler (Y-1) | 0.6 g |
| Yellow coupler (Y-2) | 0.32 g |
| DIR compound (D-1) | 0.003 g |
| DIR compound (D-2) | 0.006 g |
| High-boiling solvent (Oil-2) | 0.18 g |
| Gelatin | 1.3 g |
| Layer 10: High-speed blue-sensitive emulsion layer (BH) | |
| A silver iodobromide emulsion having an average grain size of 0.8 μm and an average iodine content of 8.5 mol % | 0.5 g |
| Sensitizing dye (S-10) | $3 \times 10^{-4}$ mol/Ag mol |
| Sensitizing dye (S-11) | $1.2 \times 10^{-4}$ mol/Ag mol |
| Yellow coupler (Y-1) | 0.18 g |
| Yellow coupler (Y-2) | 0.10 g |
| High-boiling solvent (Oil-2) | 0.05 g |
| Gelatin | 2.0 g |
| Layer 11: Protective layer 1 (PRO-1) | |
| Silver iodobromide emulsion having an average grain size of 0.08 μm | 0.3 g |
| UV absorbent (UV-1) | 0.07 g |
| UV absorbent (UV-2) | 0.10 g |
| Additive (HS-1) | 0.2 g |
| Additive (HS-2) | 0.1 g |
| High-boiling solvent (Oil-1) | 0.07 g |
| High-boiling solvent (Oil-3) | 0.07 g |
| Gelatin | 0.8 g |
| Layer 12: Protective layer 2 (PRO-2) | |
| Compound A | 0.04 g |
| Compound B | 0.004 g |
| Polymethyl methacrylate having an average particle size of 3 μm | 0.02 g |
| Particles of copolymer of methyl methacrylate: ethyl methacrylate:methacrylic acid = 3:3:4 in weight ratio, having an average particle size of 3 μm | 0.13 g |
| Gelatin | 0.7 g |

Preparation of silver iodobromide emulsion

The silver iodobromide emulsion applied to layer 10 was prepared in the following manner.

A silver iodobromide emulsion was prepared in a double-jet process in which monodisperse type silver iodobromide grains having an average grain size of 0.33 μm and a silver iodide content of 2 mol % were used as the seed crystals of the emulsion.

With keeping the temperature, pAg and pH of a solution having the following composition at 70° C., a pAg of 7.8 and 7.0, respectively, and keeping it stirred well, a seed emulsion equivalent to 0.34 mols was added thereto.

Formation of an internal high iodine phase-core phase

Thereafter, while solution <H-1> having the following composition and solution <S-1> having the following composition were kept at a flow rate of 1:1, they were then added by taking 86 minutes at an accelerated flow, at which the final flow was 3.6 times as much as the initial flow.

Formation of an external low iodine phase-shell phase

Successively, while keeping the pAg and pH were at 10.1 and 6.0, respectively, solutions <H-2> and <S-2> were each added at a flow rate of 1:1 by taking 65 minutes at an accelerated flow, at which the final flow was 5.2 times as much as the initial flow.

The pAg and pH thereof in the course of forming the grains were each controlled by making use of an aqueous potassium bromide solution and an aqueous 56% acetic acid solution. After completing the grain formation, the grains were washed in an ordinary flocculation process and then gelatin was so added that the mixture thereof was dispersed again. The pH and pAg of the resulting redispersed matter were controlled to be 5.8 and 8.06 at 40° C., respectively.

The resulting emulsion was proved to be a monodisperse type emulsion containing octahedral silver iodobromide grains having an average grain size of 0.80 μm, a distribution range of 12.4% and a silver iodide content of 8.5 mol %.

| Solution <G-1> | |
|---|---|
| Osseous gelatin | 100.0 g |
| A methanol solution of the following compound-I of 10 wt % | 25.0 ml |
| Aqueous 28% ammonia solution | 440.0 ml |
| Aqueous 56% acetic acid solution | 660.0 ml |
| Add water to make | 5000.0 ml |
| *Compound-I: Sodium polypropyleneoxy.polyethyleneoxy. disuccinate | |
| Solution <H-1> | |
| Osseous gelatin | 82.4 g |

-continued

| | |
|---|---|
| Potassium bromide | 151.6 g |
| Potassium iodide | 90.6 g |
| Add water to make | 1030.5 ml |
| Solution <S-1> | |
| Silver nitrate | 309.2 g |
| Aqueous 28% ammoniacal solution | An amount necessary to make an ammoniacal silver nitrate solution |
| Add water to make | 1030.5 ml |
| Solution <H-2> | |
| Osseous gelatin | 302.1 g |
| Potassium bromide | 770.0 g |
| Potassium iodide | 33.2 g |
| Add water to make | 3776.8 ml |
| Solution <S-2> | |
| Silver nitrate | 1133.0 g |
| Aqueous 28% ammoniacal solution | An amount necessary to make an ammoniacal silver nitrate solution |
| Add water to make | 3776.8 ml |

The silver iodobromide emulsions applied to the emulsion layers except that of layer 10 were varied in the average grain sizes of the seed crystals, the temperatures, pAg's, pH's, flows, adding time and halide compositions, in the same manners as above-mentioned, so that each of the above-mentioned emulsions which were each different in average grain sizes and silver iodide contents was prepared.

The resulting emulsions were each proved to be core/shell type monodispersive emulsions having a distribution range of not more than 20%. Each of the emulsions was subjected to an optimum chemical ripening in the presence of sodium thiosulfate, chloroauric acid and ammonium thiocyanate and then a sensitizing dye, 4-hydroxy-6-methyl-1,3,3a,7-tetrazaindene and 1-phenyl-5-mercaptotetrazole were each added thereto.

The above-mentioned light-sensitive materials further contained compounds Su-1 and Su-2, a viscosity controller, layer hardeners H-1 and H-2, stabilizer ST-1, antifoggants AF-1 and AF-2 (the former having the weight average molecular weights of 10,000 and the latter having 1,100,000, respectively), dyes AI-1 and AI-2, and compound DI-1 (in an amount of 9.4 mg/m$^2$).

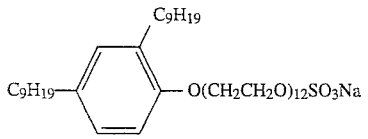

UL-1

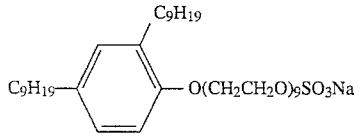

UL-2

-continued
UL-4
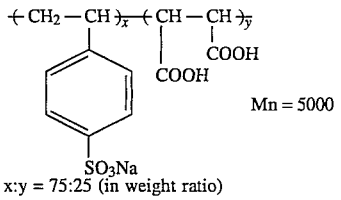
Mn = 5000
x:y = 75:25 (in weight ratio)
UL-5
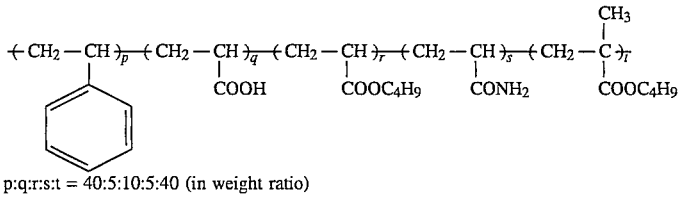
p:q:r:s:t = 40:5:10:5:40 (in weight ratio)
UL-6
A mixture of the 3 compounds having a ratio of 1:1:1
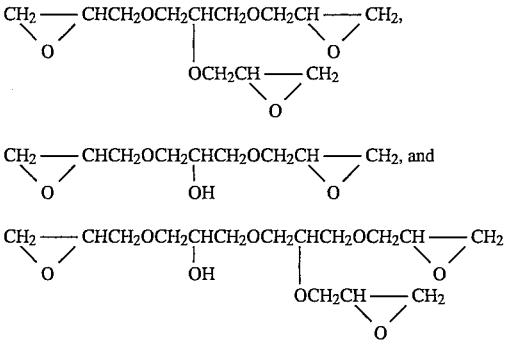
C-1
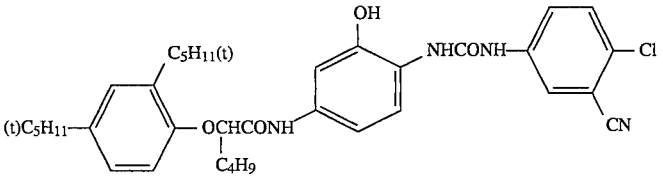
C-2
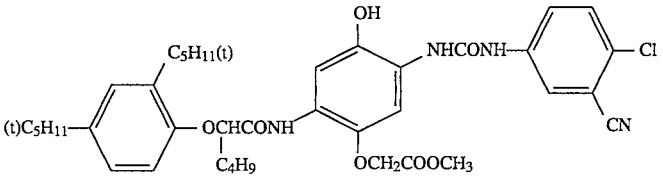
M-1
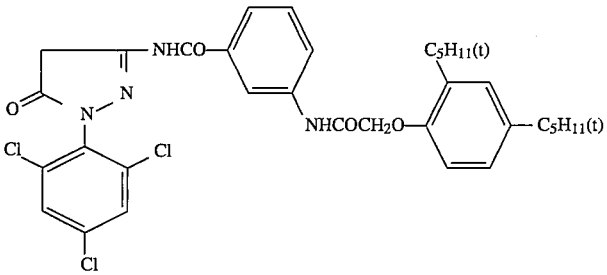

-continued
M-2
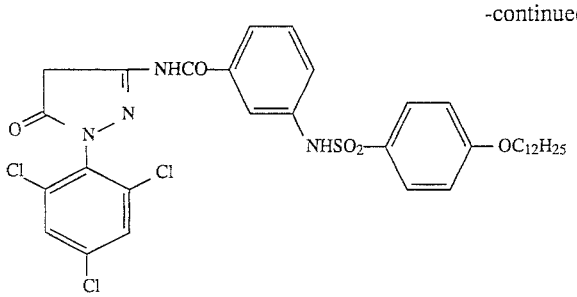
Y-1
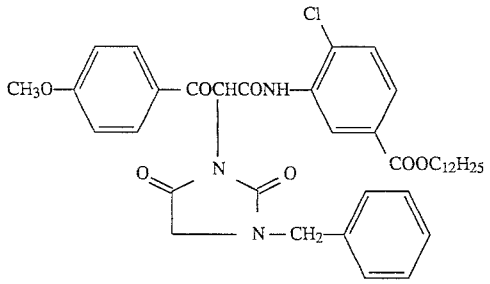
Y-2
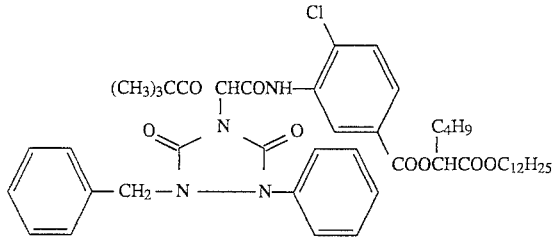
CC-1
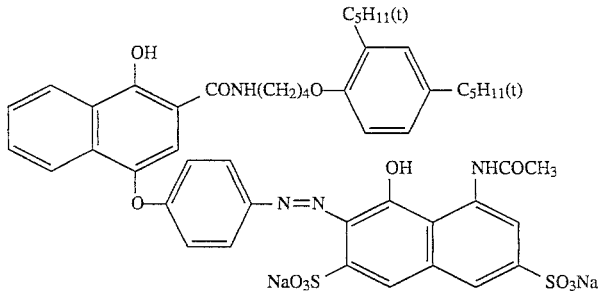
CM-1
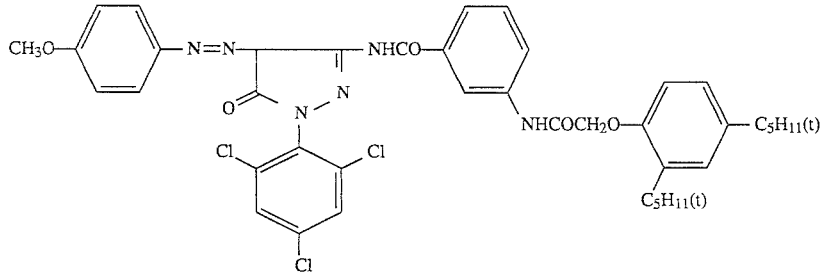

-continued
D-1
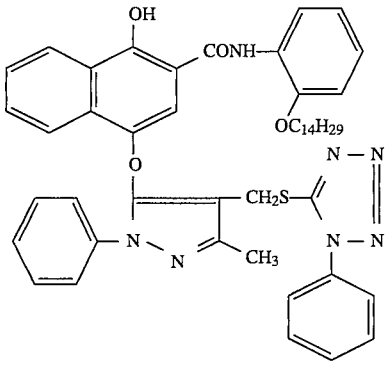
D-2
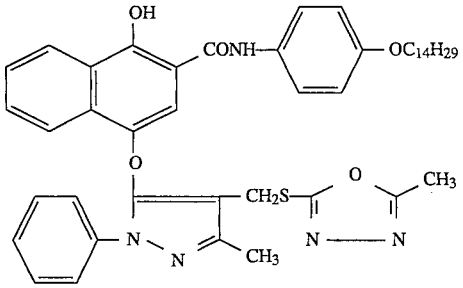
D-3
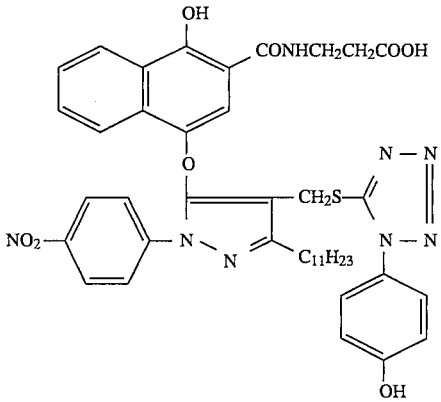
UV-1
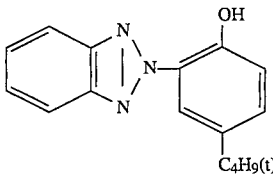
UV-2
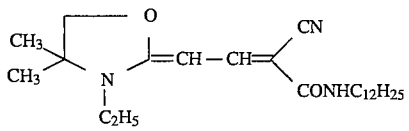
S-1
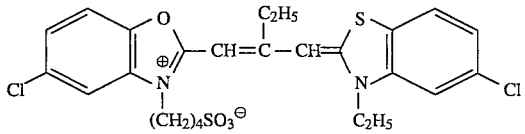

-continued
S-2
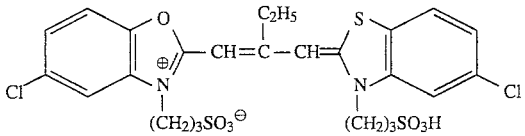
S-3
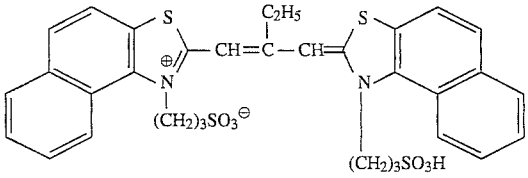
S-4
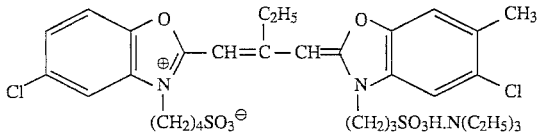
S-5
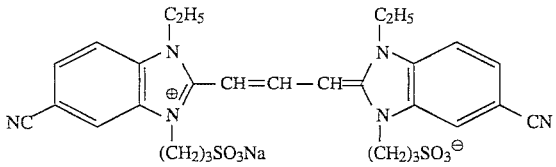
S-6
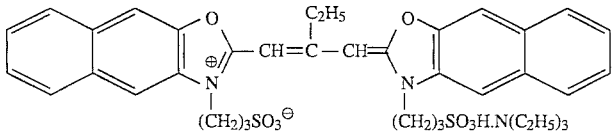
S-7
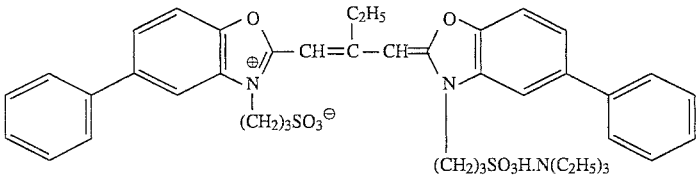
S-8
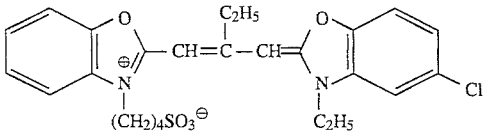
(S-9)
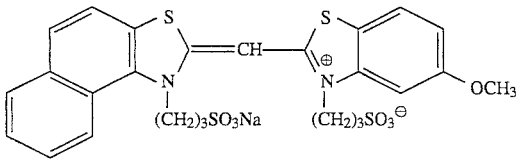
(S-10)
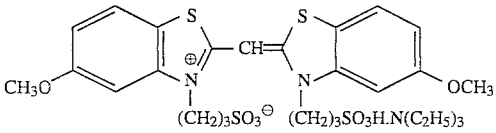
(S-11)
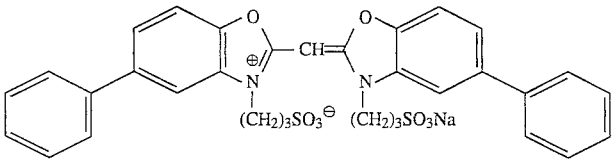

-continued
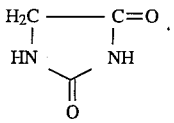
HS-1
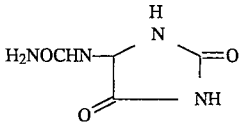
HS-2
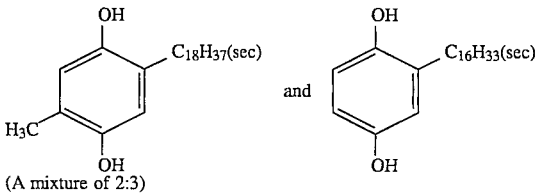
(A mixture of 2:3)
SC-1
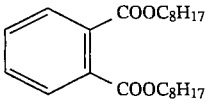
Oil-1
Oil-2
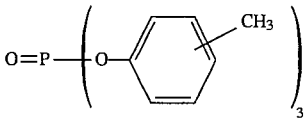
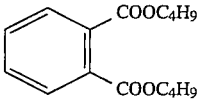
Oil-3
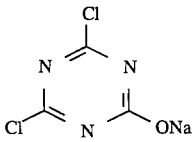
H-1
$(CH_2{=}CHSO_2CH_2)_2O$
H-2
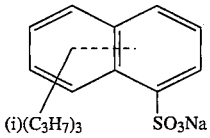
SU-1
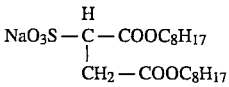
SU-2
$C_8F_{17}SO_2NH(CH_2)_3N^+(CH_3)_3Br^-$
FK-1
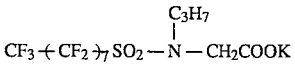
FA-1
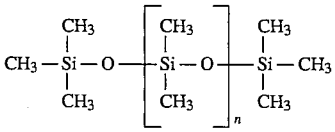
(weight average molecular weight = 30,000)
Compound A -continued
Compound B
$NaO_3S-CH(CH_2-COOCH_2(CF_2CF_2)_3H)-COOCH_2(CF_2CF_2)_3H$
DI-1
(a mixture of the following 3 components)
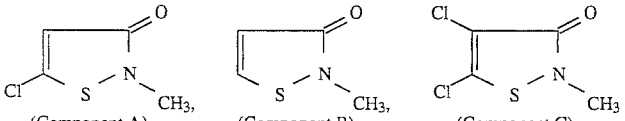
(Component A) (Component B) (Component C)
Components A:B:C = 50:46:4 (in mol ratio)
AI-1
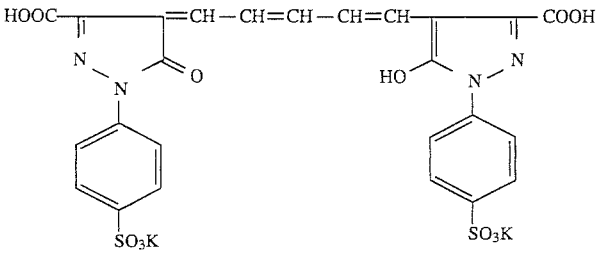
AI-2
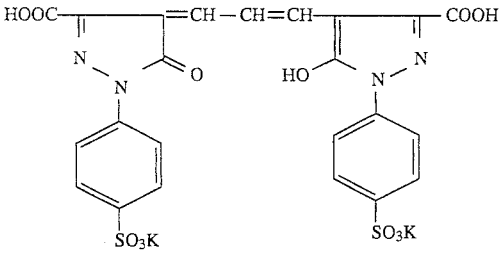
ST-1
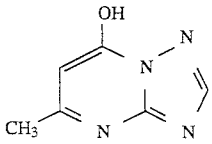
AF-1
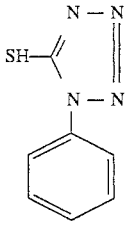
AF-2
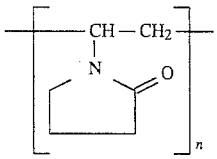
UL-3
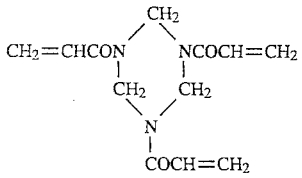
The whole thickness of the resulting silver halide photographic light-sensitive material was proved to be 120μ.

C. Preparation of photographic film package

Each of the photographic film prepared by coating a <backing layer> and an <emulsion layer> was slit to be 35 mm in width and was then cut off to be 118 cm in length. Each one of the resulting strips thereof was rolled up in full length into such a cartridge as shown in Table 1, so that the package samples 001 through 025 of the photographic films each different in void ratios could be provided. Out of the cartridges, type A was in a size equivalent to the current type and types B through E were each in a miniaturized size.

TABLE 1

| | Inner size of cartridge barrel (mm) | Outer size of spool (mm) |
|---|---|---|
| A: ISO 1007 size | 22 | 11 |
| B: Miniaturized (1) | 19 | 11 |
| C: Miniaturized (2) | 18.5 | 11 |
| D: Miniaturized (3) | 16.5 | 8 |
| E: Miniaturized (4) | 15.5 | 6.5 |

Evaluation procedures

The resulting package samples 001 through 025 of photographic films were evaluated as follows. The results thereof will be shown in Table 2.

Procedures for evaluating curvature produced in the widthwise direction of support A film was taken out from a sample and an emulsion layer and a backing layer were peeled off by making use of pancreatin or an aqueous sodium hypochlorite solution. Then, the sample was cut off to be 35 mm in the widthwise direction of the film and 2 to 3 mm width in the lengthwise direction thereof. The resulting curvature in the widthwise direction of the film was measured in the surroundings of 23° C. and 55%RH (after rehumidified for 24 hrs.), so that the measurement result was regarded as the curvature of the subject support. Every curvature were each herein expressed by a reciprocal number of a curvature radius (in the unit of $m^{-1}$). The signs were herein expressed by + (plus) when a curl was produced toward an emulsion layer side, and by − (minus) when a curl was produced to a backing layer side.

No curvature of the supports had a change either immediately after preparing each support or before and after coating each emulsion layer and backing layer.

<Core-set curl>

After rehumidifying each sample for one day long under the conditions of 23° C. and 55%RH, the samples were each heat-treated for 4 hours under the conditions of 55° C. and 20%RH. Thereafter, the samples were each allowed to cool for one hours in the surroundings of 23° C. and 55%RH and then the subject films were each taken out of a cartridge. The part of each film rolled near the core of the cartridge, the part thereof in the middle and the part thereof outside the roll were both cut off every 10 cm in the lengthwise direction. The curvatures of every core-set roll of each cut piece were measured after passing one minute. The resulting curvatures will be each expressed by a reciprocal number of the subject curvature radius (in the unit of $m^{-1}$). The signs will be herein expressed by + (plus) when a curl was produced to an emulsion layer side and by − (minus) when a curl was produced to a backing layer side.

<Splicer aptitude.core-set curl remained after processing>

After rehumidifying each sample for one day long under the conditions of 23° C. and 55%RH, the samples were each heat-treated for 4 hours under the conditions of 55° C. and 20%RH. Thereafter, the samples were each allowed to cool for one hours in the surroundings of 23° C. and 55%RH and, after the samples were spliced by making use of a film splicer (Model PS-35-2: manufactured by Noritsu Koki Co., Ltd.), the spliced samples were developed in an ordinary process through an automatic film-processor (Model NCV60: manufactured by Noritsu Koki Co., Ltd.).

Splicer aptitude

The evaluation thereof were made in the following three stages. It is to be absolutely impermissible in practical application to produce any clogging or fold of a film loaded inside a film splicer, but the subject to an evaluation is to be qualified by the following grade B.

Grade A: No clogging nor fold produced;

Grade B: No clogging nor fold produced, but the leading end of a film can hardly be inserted; and Grade C: A clogging and fold produced.

Core-set curling remained after processing

Figure 3:
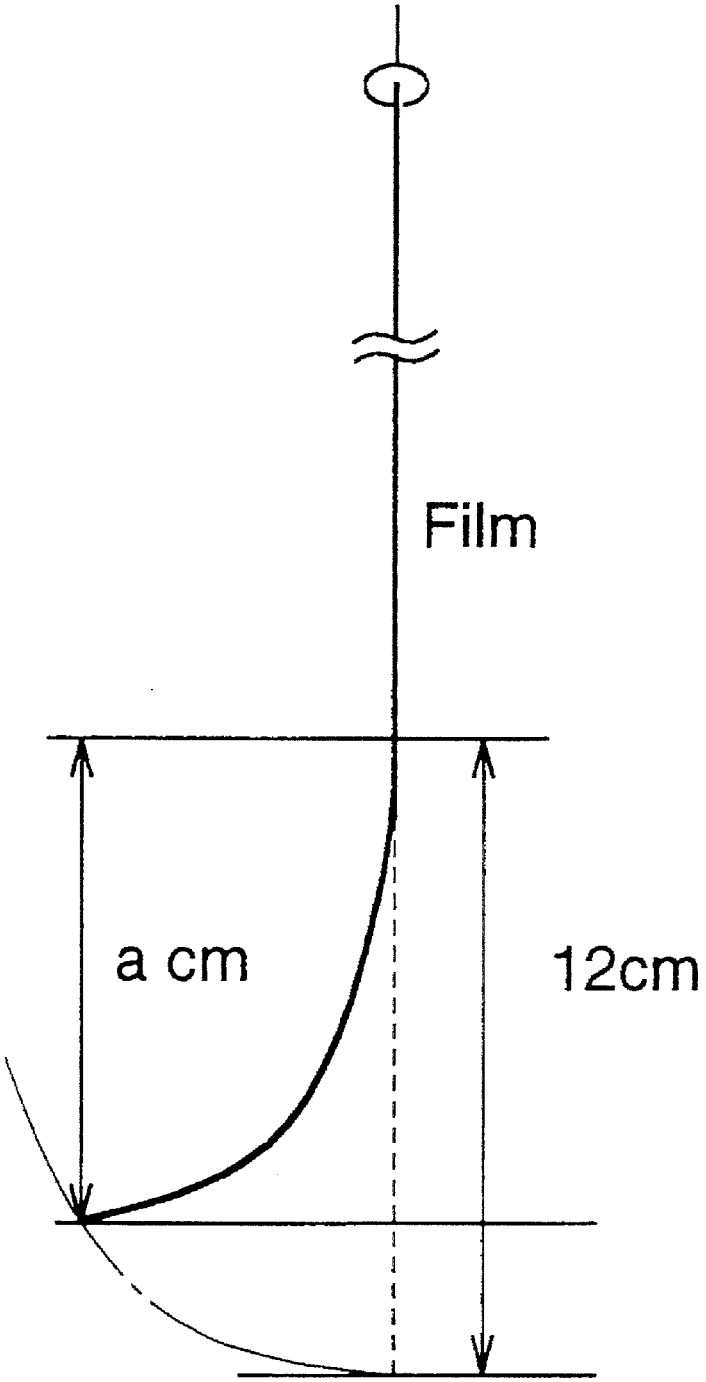
FIG. 3 is an illustration of measuring a core set curl of a photographic film.

After completing the processing, each rolled film sample was caught by the outside end thereof and was then hung thereby under the surroundings of 23° C. and 55%RH. The sample films were each humidified for one day. When each sample was hung naturally, the length (a cm)* of the hanging (*see FIG. 3) was measured in the port. ion 12 cm apart from the film end equivalent to the core of a roll. A percentage of the hanging length in cm to the original length 12 cm was obtained, and each evaluation was made in the following three stages.

From the viewpoint of the characteristics of photographic films, it is preferable to be not lower than grade B.

Grade A: Not lower than 70%;

Grade B: Within the range of 50% to lower than 70%; and

Grade C: Lower than 50%

<Drawing out load>

A sample of package is thermally treated at 55° C., 22% for 4 hours after rehumidifying for 24 hours in an atmosphere of 23° C., 55%RH. Then the sample is stand for 1 hour for cooling, and a load necessary for drawing out the film rolled in the cartridge is measured by an ordinary push-pull gage. The maximum value of the load is defined as the drawing out load.

TABLE 2

| | | Support | | | | | | | Core-set curl | | Core-set curl | Drawing |
|---|---|---|---|---|---|---|---|---|---|---|---|---|
| Sample No. | For inv. or comp. | Support No. | Layer arrangement, $M_1$: Copolymeric polyester, P: Polyethylene terephthalate | Thickness ratio of each layer | Thickness ratio, dA/dB (on 3 layers only) | Curvature to width-wise direction ($m^{-1}$) | Cartridges A–E | Free space ratio | Core-set curvature ($m^{-1}$) | Splicer aptitude | remained after processing | out load (g) |
| 001 | Comp. | 1 | $M_1$ | — | — | 0 | A | 0.495 | 110 | B | B | 50 |
| 002 | Comp. | 1 | $M_1$ | — | — | 0 | B | 0.236 | 130 | C | C | 85 |
| 003 | Comp. | 1 | $M_1$ | — | — | 0 | C | 0.171 | 140 | C | C | 125 |
| 004 | Comp. | 1 | $M_1$ | — | — | 0 | D | 0.119 | 150 | C | C | 180 |
| 005 | Comp. | 1 | $M_1$ | — | — | 0 | E | 0.074 | 160 | C | C | 245 |
| 006 | Comp. | 2 | $M_1/P/M_1$ | 1/2/1 | 1 | 0 | A | 0.495 | 99 | A | A | 50 |
| 007 | Inv. | 2 | $M_1/P/M_1$ | 1/2/1 | 1 | 0 | B | 0.236 | 105 | A | A | 56 |
| 008 | Inv. | 2 | $M_1/P/M_1$ | 1/2/1 | 1 | 0 | C | 0.171 | 111 | B | A | 62 |
| 009 | Inv. | 2 | $M_1/P/M_1$ | 1/2/1 | 1 | 0 | D | 0.119 | 115 | B | B | 68 |
| 010 | Inv. | 2 | $M_1/P/M_1$ | 1/2/1 | 1 | 0 | E | 0.074 | 120 | B | B | 77 |
| 011 | Comp. | 3 | $M_1P/M_1$ | 1/2/3 | 3 | −16 | A | 0.495 | 95 | A | A | 48 |
| 012 | Inv. | 3 | $M_1/P/M_1$ | 1/2/3 | 3 | −16 | B | 0.236 | 100 | A | A | 55 |
| 013 | Inv. | 3 | $M_1/P/M_1$ | 1/2/3 | 3 | −16 | C | 0.171 | 105 | A | A | 60 |
| 014 | Inv. | 3 | $M_1/P/M_1$ | 1/2/3 | 3 | −16 | D | 0.119 | 110 | B | A | 65 |
| 015 | Inv. | 3 | $M_1/P/M_1$ | 1/2/3 | 3 | −16 | E | 0.074 | 115 | B | B | 73 |
| 016 | Comp. | 4 | $M_1/P/M_1$ | 1/2/5 | 5 | −35 | A | 0.495 | 97 | A | A | 49 |
| 017 | Inv. | 4 | $M_1/P/M_1$ | 1/2/5 | 5 | −35 | B | 0.236 | 102 | A | A | 56 |
| 018 | Inv. | 4 | $M_1/P/M_1$ | 1/2/5 | 5 | −35 | C | 0.171 | 106 | A | A | 60 |
| 019 | Inv. | 4 | $M_1/P/M_1$ | 1/2/5 | 5 | −35 | D | 0.119 | 110 | B | A | 67 |
| 020 | Inv. | 4 | $M_1/P/M_1$ | 1/2/5 | 5 | −35 | E | 0.074 | 116 | B | B | 75 |
| 021 | Comp. | 5 | $M_1/P/M_1$ | 1/2/6 | 6 | −38 | A | 0.495 | 100 | A | A | 49 |
| 022 | Inv. | 5 | $M_1/P/M_1$ | 1/2/6 | 6 | −38 | B | 0.236 | 105 | A | A | 56 |
| 023 | Inv. | 5 | $M_1/P/M_1$ | 1/2/6 | 6 | −38 | C | 0.171 | 110 | B | A | 62 |
| 024 | Inv. | 5 | $M_1/P/M_1$ | 1/2/6 | 6 | −38 | D | 0.119 | 115 | B | B | 70 |
| 025 | Inv. | 5 | $M_1/P/M_1$ | 1/2/6 | 6 | −38 | E | 0.074 | 120 | B | B | 82 |

inv.: invention
comp.: comparison

As is obvious from the above-given Table 2, it was proved that the samples of the invention can be improved in core-set curl and can also be excellent in both splicer aptitude and core-set curl remained after processing, as compared to the comparative examples 001–004 using the monolayer support even when small cartridges were used. It was further proved to be more excellent when a photographic support is comprised of an asymmetrically multilaminated polyester film and also when the support has a curvature to the side of the backing layer thereof.

When making use of an A-sized cartridge (of a current type), that is, when a void ratio is higher than 0.25, it is not suitable to miniaturize a camera, though a core-set curl and a core-set curl after processing may be excellent.

When making use of cartridges B through D each suitable for miniaturizing a camera, that is, when a void ratio is not higher than 0.25, the invention can make excellent a core-set curl and a core-set curl after processing. Therefore, the invention can achieve the miniaturization of a camera.

EXAMPLE 2

A. Preparation of support

Preparation of support 6

Calcium acetate of 0.1 parts by weight and 0.03 parts by weight of antimony trioxide were added to 100 parts by weight of dimethyl terephthalate, 70 parts by weight of ethylene glycol, 10 parts by weight of 5-sodium dimethyl sulfoisophthalate and 10 parts by weight of dimethyl adipate, and an ester-exchange reaction was carried out in an ordinary process. To the resulting product, 0.05 parts by weight of trimethyl phosphate was added and then the temperature was gradually raised and the pressure was also gradually reduced so that a polymerization was carried out under the conditions of 280° C. and 0.5 mmHg, so that copolymerized polyester ($M_2$) having an intrinsic viscosity of 0.55 was obtained.

After vacuum-drying the resulting copolymerized polyester ($M_2$) at 150° C., it was fusedly extruded at 280° C. and was then so quenched as to be fixed on a quenching drum, so that an unstretched film could be prepared. After the resulting unstretched film was stretched at 90° C. in the longitudinal direction 3.5 times as long as the original length and, further, it was stretched at 95° C. in the lateral direction 3.7 times as wide as the original width, the stretched film was heatedly fixed at 200° C., so that a 90μ-thick polyester film support 6 was obtained.

Preparation of support 7

Support 7 was obtained in the same manner as in the preparation of support 3, except that copolymerized polyester $M_1$ was replaced by $M_2$.

Preparation of support 8

Support 8 was obtained in the same manner as in support 7, except that the polyethylene terephthalate layer was replaced by a polyester layer ($P+M_2$) comprising copolymerized polyester ($M_2$) in a proportion of 30 wt % and polyethylene terephthalate in a proportion of 70 wt %.

B. Preparation of photographic film

A silver halide photographic film was prepared in the same manner as in Example 1, except that layers 1 and 2 of the backing layer were replaced by the following layers <MC-1> and <OC-1>, respectively.

<MC-1>

The following components were mixed up together by making use of a dissolver and the resulting mixture thereof was dispersed by making use of a sand mill, so that a dispersion solution could be prepared. The layer <MC-1> was coated so as to have a dried and hardened thickness of 2 μm.

| | |
|---|---|
| Nitrocellulose | 35 parts by weight |
| Polyurethane resin | 35 parts by weight |
| Lauric acid | 1 part by weight |
| Oleic acid | 1 part by weight |
| Butyl stearate | 1 part by weight |
| Cyclohexanone | 75 parts by weight |
| Methyl ethyl ketone | 150 parts by weight |
| Toluene | 150 parts by weight |
| Co-adhered $\gamma$-$Fe_2O_3$ (having a major axis length of 0.2 μm, a minor axis length of 0.02 μm and Hc = 650 Oe) | 5 parts by weight |
| <OC-1> | |

Over MC-1, the following coating solution was so coated as to be 10 ml/m$^2$.

| | |
|---|---|
| Carnauba wax | 1 g |
| Toluene | 700 ml |
| Methyl ethyl ketone | 300 ml |

The whole thickness of the resulting photographic film was proved to be 120μ.

C. Preparation of photographic film package

Photographic film packages 026 through 040 were each prepared in the same manner as in Example 1, except that photographic films were rolled up in the cartridges of the type A through E, respectively.

In the same manner as in Example 1, the resulting core-set curl, splicer aptitude and core-set curl after processing were evaluated. The results thereof will be shown in Table 3.

TABLE 3

| | | Support | | | | | | | Core-set curl | | | |
|---|---|---|---|---|---|---|---|---|---|---|---|---|
| Sample No. | For inv. or comp. | Support No. | Layer arrangement, $M_2$: Copolymeric polyester, P: Polyethylene terephthalate | Thickness ratio of each layer | Thickness ratio, dA/dB (on 3 layers only) | Curvature to width-wise direction (1/m) | Cartridges A–E | Free space ratio | Core-set curvature (1/m) | Splicer aptitude | Core-set curl remained after processing | Drawing out load (g) |
| 026 | Comp. | 6 | $M_2$ | — | — | 0 | A | 0.503 | 111 | B | B | 51 |
| 027 | Comp. | 6 | $M_2$ | — | — | 0 | B | 0.248 | 128 | C | C | 84 |
| 028 | Comp. | 6 | $M_2$ | — | — | 0 | C | 0.185 | 139 | C | C | 124 |
| 029 | Comp. | 6 | $M_2$ | — | — | 0 | D | 0.134 | 150 | C | C | 178 |
| 030 | Comp. | 6 | $M_2$ | — | — | 0 | E | 0.089 | 160 | C | C | 240 |
| 031 | Comp. | 7 | $M_2/P/M_2$ | 1/2/3 | 3 | −18 | A | 0.503 | 95 | A | A | 48 |
| 032 | Inv. | 7 | $M_2/P/M_2$ | 1/2/3 | 3 | −18 | B | 0.248 | 101 | A | A | 55 |
| 033 | Inv. | 7 | $M_2/P/M_2$ | 1/2/3 | 3 | −18 | C | 0.185 | 105 | A | A | 59 |
| 034 | Inv. | 7 | $M_2/P/M_2$ | 1/2/3 | 3 | −18 | D | 0.134 | 111 | B | A | 65 |
| 035 | Inv. | 7 | $M_2/P/M_2$ | 1/2/3 | 3 | −18 | E | 0.089 | 115 | B | B | 72 |
| 036 | Comp. | 8 | $M_2/(P+M_2)/M_2$ | 1/2/3 | 3 | −15 | A | 0.503 | 95 | A | A | 48 |
| 037 | Inv. | 8 | $M_2/(P+M_2)/M_2$ | 1/2/3 | 3 | −15 | B | 0.248 | 102 | A | A | 56 |
| 038 | Inv. | 8 | $M_2/(P+M_2)/M_2$ | 1/2/3 | 3 | −15 | C | 0.185 | 107 | A | A | 60 |
| 039 | Inv. | 8 | $M_2/(P+M_2)/M_2$ | 1/2/3 | 3 | −15 | D | 0.134 | 110 | B | A | 66 |
| 040 | Inv. | 8 | $M_2/(P+M_2)/M_2$ | 1/2/3 | 3 | −15 | E | 0.089 | 116 | B | B | 74 |

inv.: invention
comp.: comparison

As is obvious from Table 3, it was proved that the samples of the invention could improve in core-set curl and could be excellent in splicer aptitude and core-set curl eliminability as well.

EXAMPLE 3

A. Preparation of support

Preparation of support 9

Copolymerized polyester ($M_3$) was obtained in the same manner as in the preparation of support 6, except that 10 parts by weight of 5-sodium dimethyl sulfoisophthalate was replaced by 10 parts by weight of disodium 3-5-di(methyloxy carbonyl)phenyl phosphonate.

A 90μ-thick support 9 was also prepared in the same manner as in the preparation of support 6.

Preparation of support 10

Support 10 was prepared under the same conditions an in support 6, except that polyethylene terephthalate (P) and copolymerized polyester ($M_3$) were used and the thickness ratio of the polyethylene terephthalate/copolymerized polyester ($M_3$) could be set from the emulsion layer coated side of the support by making use of two units of extruder, as shown in Table 4.

Preparation of support 11

Calcium acetate hydrate of 0.1 parts by weight was added as an ester-exchange catalyst to 100 parts by weight of dimethyl 2-6-naphthalene dicarboxylate and 60 parts by weight of ethylene glycol and an ester-exchange reaction was carried out in an ordinary process. To the resulting product, 0.05 parts by weight of antimony trioxide and 0.03 parts by weight of trimethyl phosphate were added. Then, the temperature was gradually raised and the pressure was also gradually reduced and a polymerization was carried out under the conditions of 290° C. and 0.5 mmHg, so that polyethylene 2-6-naphthalate (PEN) having an intrinsic viscosity of 0.60 was obtained.

Also, 0.05 parts by weight of magnesium acetate hydrate was added as an ester-exchange catalyst to 100 parts by weight of dimethyl 2-6-naphthalene dicarboxylate and 60 parts by weight of ethylene glycol and then an ester-exchange reaction was carried out in an ordinary process. To the resulting product, there added by 18 parts by weight of an ethylene glycol solution containing 5-sodium sulfodi(β-hydroxyethyl)isophthalate with a concentration of 35 wt %, 6 parts by weight of polyethylene glycol having a number average molecular weight of 3000, 0.05 parts by weight of antimony trioxide, 0.03 parts by weight of trimethyl phosphate, 0.2 parts by weight of Irganox (manufactured by Ciba-Geigy AG) and 0.04 parts by weight of sodium acetate, respectively. Successively, the temperature was gradually raised and the pressure was also gradually reduced and a polymerization was carried out under the conditions of 290° C. and 0.5 mmHg, so that copolymerized polyester ($M_4$) having an intrinsic viscosity of 0.55 was obtained.

After the resulting PEN and copolymerized polyester ($M_4$) were each vacuum-dried at 150° C., they were each melt extruded at 300° C. by making use of two units of extruder, respectively, and the two extruded layers were adhered together layerwise inside a T-die so that the thickness ratio of PEN/copolymerized polyester ($M_4$) could have such a layer arrangement in the order from the emulsion layer side of the support, as shown in Table 4. The resulting layer-like adhered matter was so quenched as to be fixed on a quenching drum, so that an unstretched multi-laminated polyester film could be prepared. The resulting unstretched multi-laminate film was stretched at 135° C. 3.5 times as long as the original length into the longitudinal direction and was then stretched at 150° C. 3.5 times as wide as the original width into the lateral direction, and the resulting stretched film was heatedly fixed at 240° C., so that a 90 μm-thick laminated polyester film support 11 was obtained.

B. Preparation of photographic film

Silver halide photographic light-sensitive materials were each prepared in the same manner as in Example 2, except that an emulsion layer and a backing layer, <MC-1> and <OC-1>, were each coated on supports 9 and 10, respectively.

C. Preparation of photographic film packages

Photographic film packages 041 through 055 were each prepared in the same manner as in Example 1, except that the films were rolled in the cartridges of the types A through E, respectively.

In the same procedures, the resulting core-set curl, splicer aptitude and core-set curl after processing were each evaluated. The results thereof will be shown in Table 4.

TABLE 4

| | | Support | | | | | | | Core-set curl | | Core-set curl | Drawing |
|---|---|---|---|---|---|---|---|---|---|---|---|---|
| Sample No. | For inv. or comp. | Support No. | Layer arrangement, $M_3$, $M_4$: Copolymeric polyester, P: Polyethylene terephthalate | Thickness ratio of each layer | Thickness ratio, dA/dB (on 3 layers only) | Curvature to width-wise direction (l/m) | Cartridges A–E | Free space ratio | Core-set curvature (l/m) | Splicer aptitude | remained after processing | out load (g) |
| 041 | Comp. | 9 | $M_3$ | — | — | 0 | A | 0.503 | 110 | B | B | 50 |
| 042 | Comp. | 9 | $M_3$ | — | — | 0 | B | 0.248 | 130 | C | C | 85 |
| 043 | Comp. | 9 | $M_3$ | — | — | 0 | C | 0.185 | 139 | C | C | 122 |
| 044 | Comp. | 9 | $M_3$ | — | — | 0 | D | 0.134 | 150 | C | C | 180 |
| 045 | Comp. | 9 | $M_3$ | — | — | 0 | E | 0.089 | 162 | C | C | 250 |
| 046 | Comp. | 10 | $P/M_3$ | 2/3 | — | −20 | A | 0.503 | 95 | A | A | 48 |
| 047 | Inv. | 10 | $P/M_3$ | 2/3 | — | −20 | B | 0.248 | 101 | A | A | 56 |
| 048 | Inv. | 10 | $P/M_3$ | 2/3 | — | −20 | C | 0.185 | 105 | A | A | 60 |

TABLE 4-continued

| | | Support | | | | | | | Core-set curl | | | |
|---|---|---|---|---|---|---|---|---|---|---|---|---|
| Sample No. | For inv. or comp. | Support No. | Layer arrangement, $M_3$, $M_4$: Copolymeric polyester, P: Polyethylene terephthalate | Thickness ratio of each layer | Thickness ratio, dA/dB (on 3 layers only) | Curvature to width-wise direction (l/m) | Cartridges A–E | Free space ratio | Core-set curvature (l/m) | Splicer aptitude | Core-set curl remained after processing | Drawing out load (g) |
| 049 | Inv. | 10 | $P/M_3$ | 2/3 | — | −20 | D | 0.134 | 111 | B | A | 66 |
| 050 | Inv. | 10 | $P/M_3$ | 2/3 | — | −20 | E | 0.089 | 116 | B | B | 74 |
| 051 | Comp. | 11 | $PEN/M_4$ | 1/1 | — | −18 | A | 0.503 | 85 | A | A | 40 |
| 052 | Inv. | 11 | $PEN/M_{4k}$ | 1/1 | — | −18 | B | 0,248 | 90 | A | A | 42 |
| 053 | Inv. | 11 | $PEN/M_4$ | 1/1 | — | −18 | C | 0.185 | 96 | A | A | 48 |
| 054 | Inv. | 11 | $PEN/M_4$ | 1/1 | — | −18 | D | 0.134 | 100 | A | A | 55 |
| 055 | Inv. | 11 | $PEN/M_4$ | 1/1 | — | −18 | E | 0.089 | 106 | A | B | 61 |

inv.: invention
comp.: comparison

As is obvious from Table 4, it was proved that the samples of the invention could improved in core-set curl and were excellent in splicer aptitude and core-set curl after processing as well.

What is claimed is:

1. A package of photographic light-sensitive film comprising a cartridge having a cross sectional area and including a cartridge barrel, said cartridge enclosing a spool having a cross sectional area; and a strip of a photographic light-sensitive film rolled up on said spool in which the cross sectional area of said cartridge is not larger than 370 $mm^2$; the cross sectional area of said spool is not larger than 95 $mm^2$; a free space ratio V in the cartridge calculated by the following equations is not more than 0.25; and said photographic light-sensitive film comprises a silver halide emulsion layer and a support comprising two or more laminated layers each composed of a polyester or a copolymeric polyester, respectively;

$$V=(B-A)/B$$

wherein $A$ = a cross sectional area of the light-sensitive film rolled in the cartridge
= Thickness × length of the light-sensitive film rolled in the cartridge
$B$ = (the cross section area of the cartridge barrel) − (the cross sectional area of the spool).

2. The package of claim 1, wherein at least one of the layers of said support comprises a copolymeric polyester containing an aromatic dicarboxylic acid having a metal sulfonate group and a polyalkylene glycol as copolymerized components.

3. The package of claim 1, wherein said support has a widthwise direction curling degree of −5 $m^{-1}$ to −35 $m^{-1}$

4. The package of claim 1, wherein said support has an asymmetrical structure with respect to a plane which equally divides the thickness of said support.

5. The package of claim 1, wherein said cartridge has a cross sectional area of 150 $mm^2$ to 370 $mm^2$.

6. The package of claim 5, wherein said cartridge has a cross sectional area of 188.6 $mm^2$ to 370 $mm^2$.

7. The package of claim 1, wherein said spool has a cross sectional area of 15 $mm^2$ to 95 $mm^2$.

8. The package of claim 7, wherein said spool has a cross sectional area of 33.2 $mm^2$ to 95 $mm^2$.

9. The package of claim 1, wherein said support is composed of three laminated layers including two outer layers and a middle layer, said outer layers having thicknesses dA and dB which satisfy the following relation:

$$.1 \leqq dA/dB \leqq .$$

10. The package of claim 9, wherein the support has a layer arrangement which has asymmetry around the middle layer.

11. The package of claim 1, wherein at least one of the layers of said support comprises a copolymeric polyester containing an aromatic dicarboxylic acid having a metal sulfonate group and a polyalkylene glycol as copolymerized components; and said support has a widthwise direction curling degree of −5 $m^{-1}$ to −35 $m^{1}$.

12. The package of claim 11, wherein said support has a layer arrangement which has unsymmetry structure with respect to a layer which equally divides the thickness of said support.

* * * * *